US010174490B2

(12) United States Patent
Harashima et al.

(10) Patent No.: US 10,174,490 B2
(45) Date of Patent: Jan. 8, 2019

(54) FLUSH TOILET

(71) Applicant: TOTO LTD., Kitakyushu-shi, Fukuoka (JP)

(72) Inventors: Tatsunari Harashima, Kitakyushu (JP); Ryoko Ishimaru, Kitakyushu (JP); Kenichi Nakamura, Kitakyushu (JP); Shoko Imaizumi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 31 days.

(21) Appl. No.: 15/606,991

(22) Filed: May 26, 2017

(65) Prior Publication Data

US 2017/0350108 A1 Dec. 7, 2017

(30) Foreign Application Priority Data

Jun. 7, 2016 (JP) ..... 2016-113735
Jun. 7, 2016 (JP) ..... 2016-113736

(51) Int. Cl.
*E03D 5/01* (2006.01)

(52) U.S. Cl.
CPC ..... *E03D 5/01* (2013.01); *E03D 2201/40* (2013.01)

(58) Field of Classification Search
CPC ..... E03D 5/01
USPC ..... 4/431
See application file for complete search history.

(56) References Cited

U.S. PATENT DOCUMENTS 4,159,550 A * 7/1979 Tobin, Jr. ..... E03D 9/10 4/319

* cited by examiner

*Primary Examiner* — Lauren Crane
(74) *Attorney, Agent, or Firm* — Baker & Hostetler LLP

(57) ABSTRACT

A flush toilet includes a reservoir tank assembled from above or behind to a predetermined installation position on the rear side of the conduit of a toilet main unit; a connecting pipe member, one end of which is disposed on the conduit of the toilet main unit, and the other end of which is connected to a reservoir tank; a tank-side connecting portion, disposed on the front side of the reservoir tank and connected to a connecting pipe member; and a seal member, connected in a watertight manner between a connecting pipe member and a tank-side connecting portion.

11 Claims, 26 Drawing Sheets

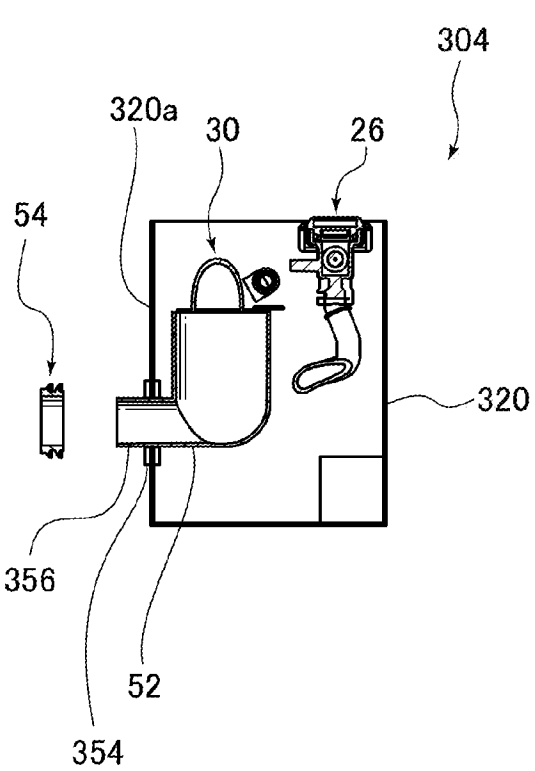
FIG.19B
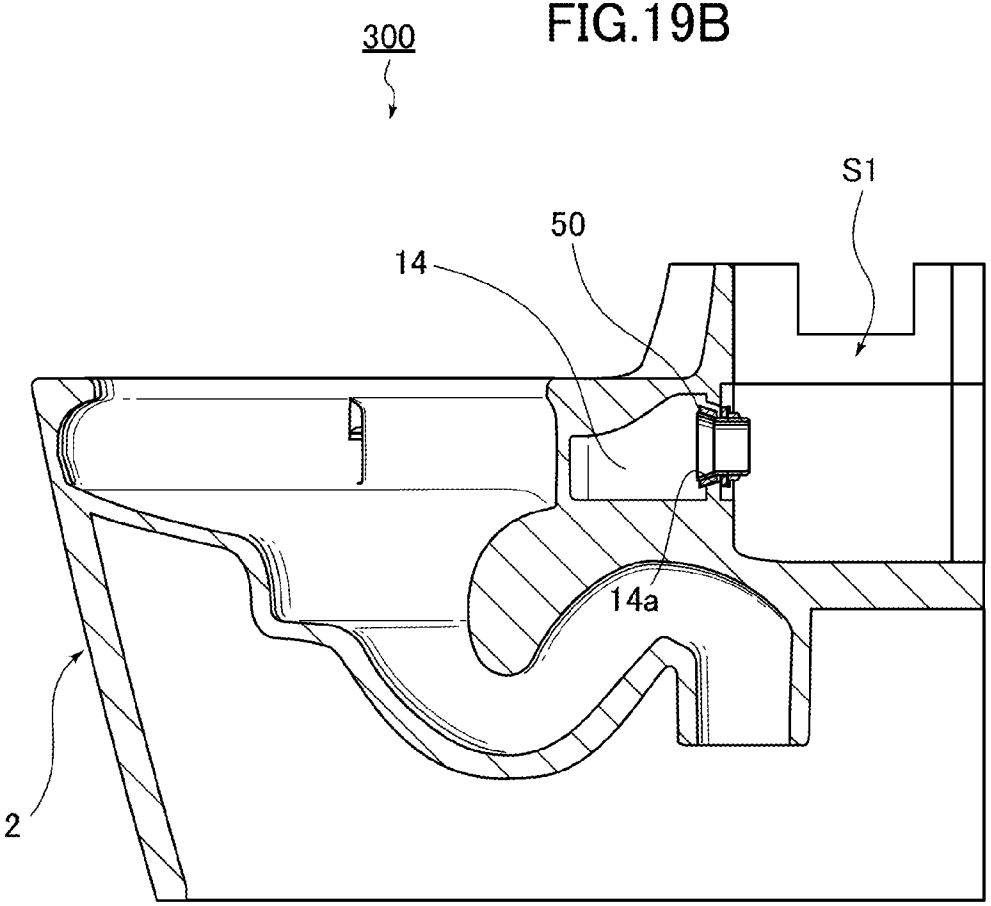

FLUSH TOILET

TECHNICAL FIELD

The present invention relates to a flush toilet, and more particularly to a flush toilet configured to be flushed with flush water supplied by using jet pump action so as to discharge waste.

BACKGROUND

For some time, known flush toilets configured to be flushed with flush water supplied by jet pump action so as to discharge waste have included, for example, the apparatus set forth in Patent Document 1 (Japanese Patent Unexamined Publication No. 2014-190065). In such apparatus, a portion or flush water supplied from a water supply source is stored, and a tank supplying flush water to the toilet main unit is installed on the top surface of the toilet main unit.

In such conventional flush toilets, a jet pump unit for inducing a jet pump action, and multiple other related parts, are installed within the tank. In order to obtain good jet pump performance in a standalone tank, therefore, it is preferable for the connection between the tank and the toilet main unit to be made outside the tank.

In recent years, however, due to diversification of flush toilet designs and greater water conservation, tanks are disposed in relatively low positions on the rear side of the toilet main unit. As a result, "low silhouette type" tanks are employed, in which the height position of the top edge of the tank is set at a low position, reducing the overall height of the flush toilet. In such low-silhouette type tanks, however, an effort to reduce the span in the front-back direction (depth direction) and width (lateral direction) in the left-right direction reduces dead space, rendering unavoidable designs in which the area around the connecting portion between the tank and the toilet main unit is surrounded.

In designs for tanks and toilet bodies in which the area around the connecting portion between the tank and the toilet main unit is surrounded in this way, it becomes difficult for a worker's hand to directly reach the connecting portion between the tank and the toilet main unit, thus impeding installation requiring direct access. This means that the operation to connect the tank and the toilet main unit in a watertight manner must be achieved by indirect means or method, making it difficult to secure watertightness.

A method is also conceivable in which access to the tank and toilet main unit connecting portion is from the inside of the tank. However, space is occupied inside the tank by many related parts in addition to the jet pump unit. Therefore space inside the tank is also reduced to the extent the tank size is reduced, making it difficult for a worker to gain direct access. This makes it difficult to directly perform the connecting operation needed to assure watertightness close to the connecting portion inside the tank.

SUMMARY

The present invention was thus undertaken in order to resolve the above-described problems with the conventional art, and has the object of providing a flush toilet with which, when connecting the tank to the toilet main unit in a watertight manner, the tank can be easily connected to the toilet main unit in a watertight manner, even when the toilet main unit-side connecting portion and the tank-side connecting portion are each covered in a manner preventing direct access by a worker to the surrounding area.

In order to accomplish the object above, the present invention is a flush toilet configured to discharge waste by flushing the flush toilet with flush water supplied by a jet pump action, the flush toilet comprising: a toilet main unit including a bowl configured to receive waste and a conduit configured to guide flush water to the bowl; a tank assembled from a top side of the toilet main unit or a rear side of the toilet main unit to a predetermined installation position in the toilet main unit further to a rear than the bowl of the toilet main unit, the tank being configured to store a portion of the flush water supplied from a water supply source and to supply the flush water to the conduit in the toilet main unit, the tank including a jet pump unit disposed on an interior of the tank, at least a portion of the jet pump unit being submerged, wherein the jet pump unit includes a jet nozzle configured to spray the flush water supplied from the water supply source, and a throat pipe including a suction port at one end of the throat pipe and an outlet at other end of the throat pipe, the outlet of the throat pipe being configured to cause the flush water to flow out toward the conduit in the toilet main unit, wherein the jet nozzle is configured to induce the jet pump action so as to increase a flow volume of flush water flowing in the throat pipe more than a flow volume of flush water sprayed from the jet nozzle by jet spraying flush water from the suction port on the throat pipe toward an interior of the throat pipe so that increased flow volume of flush water is supplied from the throat pipe toward the conduit on the toilet main unit; a toilet main unit-side connecting portion forming a toilet main unit-side connecting pipe path in the toilet main unit-side connecting portion, one end of the toilet main unit-side connecting portion being disposed either as a single piece or as a separate piece with the conduit of the toilet main unit, and other end of the toilet main unit-side connecting portion being connected to the tank; a tank-side connecting portion disposed on a front side of the tank, the tank-side connecting portion being connected to the toilet main unit-side connecting portion so as to form a tank-side connecting pipe path configured to communicate with the toilet main unit-side connecting pipe path; and a seal member disposed on either the toilet main unit-side connecting portion or the tank-side connecting portion, the seal member being configured to connect in a watertight manner between the toilet main unit-side connecting portion and the tank-side connecting portion with the tank assembled to the predetermined installation position from the top side or the rear side; wherein when the tank is connected in a watertight manner to the toilet main unit, surroundings of the toilet main unit-side connecting portion and the tank-side connecting portion are covered such that a worker cannot directly access the surroundings of the toilet main unit-side connecting portion and the tank-side connecting portion; and wherein the seal member is configured that when the tank is assembled from the top side or the rear side to the predetermined installation position, a push-in force acting on the seal member when the tank-side connecting portion is connected in a watertight manner to the toilet main unit-side connecting portion by pushing the tank into the toilet main unit-side connecting portion is set to be smaller than a pull-out force acting on the seal member when the tank-side connecting portion connected in a watertight manner to the toilet main unit-side connecting portion is pulled out and removed from the toilet main unit-side connecting portion.

According to the invention thus constituted, the invention thus constituted, when the toilet main unit-side connecting portion and the tank-side connecting portion are connected in a watertight manner to the toilet main unit, the surrounding area thereof is covered so as to be inaccessible to workers. Therefore when the tank is assembled from either above or behind to a predetermined installation position behind the bowl of the toilet main unit, the tank is pushed in by a worker relative to the toilet main unit-side connecting portion. The tank-side connecting portion is thus connected in a watertight manner to the toilet main unit-side connecting portion. At this point, the push-in force acting on the seal member is set to be smaller than the pull-out force acting on the seal member when the tank-side connecting portion, which is connected in a watertight manner to the toilet main unit-side connecting portion, is pulled out and removed from the toilet main unit-side connecting portion. Therefore when the tank-side connecting portion is connected in a watertight manner to the toilet main unit-side connecting portion by the pushing in of the tank relative to the toilet main unit-side connecting portion, the tank-side connecting portion and the toilet main unit-side connecting portion can be easily connected in a watertight manner by a relatively small push-in force.

On the other hand when the tank-side connecting portion is pulled out and removed from the toilet main unit-side connecting portion, a relatively large pull-out force is required. The tank can therefore be prevented from unintentionally separating from the toilet main unit.

In the present invention, preferably, the seal member is a packing member formed in approximately a ring shape, and the packing member includes one or more flexible projecting portions on an outer circumferential surface of the packing member, the flexible projecting portion being formed so as to project radially and outwardly over an entire circumference on the outer circumferential surface of the packing member.

According to the invention thus constituted, if a packing member is used on which no flexible projecting portions are formed on the outer circumferential surface thereof, the tank is assembled from either above or behind a predetermined installation position behind the bowl of the toilet main unit. Hence if there is an attempt to push the tank in to the wrong position when pushing the tank relative to the toilet main unit-side connecting portion, push-in resistance is relatively large, and there is a risk the toilet main unit-side connecting portion or the tank-side connecting portion will break.

In contrast, in the invention the seal member is a packing member formed in approximately a ring shape, and flexible projecting portions are formed over the entire circumference on the radially outer side of the outer circumferential surface of this packing member. Therefore when the tank is pushed in relative to the toilet main unit-side connecting portion, the degree of contact between the packing member flexible projecting portion and the toilet main unit-side connecting pipe on the toilet main unit-side connecting portion changes, and push-in resistance increases as the amount pushed in increases.

Therefore when the tank is pushed in relative to the toilet main unit-side connecting portion, the starting push-in resistance is relatively small even if the tank is pushed in at the wrong installation position. Breakage of the toilet main unit-side connecting portion or the tank-side connecting portion can therefore be prevented. In addition, the fact that the tank is being pushed in at the wrong installation position becomes evident before breakage occurs.

In the present invention, preferably, the one or more flexible projecting portions are multiple projecting portions configured to be spaced apart in an axial direction on the outer circumferential surface of the packing member.

According to the invention thus constituted, the starting push-in force and the push-in resistance can be reduced when pushing in the tank relative to the toilet main unit-side connecting portion. The tank-side connecting portion and the toilet main unit-side connecting portion can thus be easily connected in a watertight manner with a relatively small push-in force.

In the present invention, preferably, the toilet main unit-side connecting portion and the tank-side connecting portion are configured to form a connecting pipe path communicating in a vertical direction when the toilet main unit-side connecting portion and the tank-side connecting portion are connected to each other; and the flush toilet further comprises a force dispersion portion disposed to be able to support the toilet main unit-side connecting portion with the tank assembled from above to the predetermined installation position, the force dispersion portion being configured to disperse the push-in force from the tank-side connecting portion onto the toilet main unit-side connecting portion.

According to the invention thus constituted, a push-in operation is implemented to push the tank-side connecting portion downward relative to the toilet main unit-side connecting portion from above, and if excessive push-in force is applied from the tank-side connecting portion to the toilet main unit-side connecting portion, the push-in force can be dispersed by a force dispersing portion. Breakage of the toilet main unit-side connecting portion can thus be prevented.

In the present invention, preferably, further comprises a horizontally maintaining portion configured to affix the tank to the toilet main unit so that an orientation of the tank is maintained in a horizontal state.

According to the invention thus constituted, the tank can be stably affixed to the toilet main unit. Thus tank shifting can be prevented, as can destabilization of the jet pump action due to movement of the tank with each flush operation, causing fluctuation in the water level inside the tank.

In the present invention, preferably, the tank is assembled from the top side into the predetermined installation position further to the rear side than the bowl of the toilet main unit; the toilet main unit-side connecting pipe path is formed to point upward; the tank-side connecting pipe path is formed to extend upward from one end; and the tank includes a stepped portion configured to project from a front surface of the tank rearward on the interior of the tank and to extend upward from a bottom surface of the tank; wherein the stepped portion includes a top end, to which a throat pipe-side connecting portion forming the outlet of the throat pipe is connected, and on which a connecting port communicating with the tank-side connecting pipe path is formed; and the top end of the stepped portion is positioned above a full water level inside the tank so that when the tank is assembled from above to the predetermined installation position, a worker can perform a watertight connection operation to connect the toilet main unit-side connecting portion and the tank-side connecting portion in a watertight manner; wherein the stepped portion is configured to connect the tank-side connecting portion through the seal member to the toilet main unit-side connecting portion in a watertight manner when the watertight connection operation is performed.

According to the invention thus constituted, when a tank is installed by a worker from above to a predetermined installation position further to the rear side than the bowl of the toilet main unit, and the tank is connected in a watertight manner to the toilet main unit, even when the toilet main unit-side connecting portion and tank-side connecting portion are respectively covered so that a worker is unable to directly access their surrounding areas, the top end of a stepped portion inside the tank is positioned above the full water level in the tank. Thus a worker can easily and directly access the top end of the stepped portion inside the tank from the top of the tank.

Hence a worker who has directly accessed the top end of the stepped portion inside the tank can securely connect the tank-side connecting portion in a watertight manner to the toilet main unit-side connecting portion through the seal member simply by performing a watertight connecting operation at the top end of the stepped portion inside the tank to connect the toilet main unit-side connecting portion and the tank-side connecting portion in a watertight manner. In this manner, the tank can be easily connected in a watertight manner to the toilet main unit.

In the present invention, preferably, the stepped portion is a sole stepped portion formed inside the tank so as to be positioned above a minimum water level inside the tank.

According to the invention thus constituted, the space occupied by the stepped portion inside the tank can be minimized. Therefore the tank as whole can be reduced in size.

In the present invention, preferably, the tank includes in its interior a supply valve configured to supply and cut off the flush water supplied from the water supply source to the jet nozzle; and wherein the stepped portion is formed at the center portion in a left-right direction of the interior of the tank, and the supply valve and the throat pipe are disposed more on one side in the left-right direction of the interior of the tank so as to enable the watertight connection operation for a portion of the top end of the stepped portion.

According to the invention thus constituted, the tank is assembled by a worker from above to a predetermined installation position on the rear side of a conduit in the toilet main unit, and when the tank-side connecting portion is connected to the toilet main unit-side connecting portion, a worker who has directly accessed the top end of the stepped portion inside the tank is able to secure working space to connect the top end of the stepped portion inside the tank.

Therefore a worker can securely connect a portion of the top end of the stepped portion inside the tank in a watertight manner. Thus the tank-side connecting portion can securely connect in a watertight manner to the toilet main unit-side connecting portion through the seal member, so that the tank is securely connected in a watertight manner to the toilet main unit.

In the present invention, preferably, the top end of the stepped part includes an operating region surface and a front region surface, the operating region surface being formed in a left-right width direction region of the top end of the stepped part so as to enable the watertight connecting operation, and the front region surface being formed between the throat pipe-side connecting portion and the front wall portion of the tank closely adjacent to the throat pipe-side connecting portion, wherein an area of the front region surface is smaller than an area of the operating region surface.

According to the invention thus constituted, the operating region surface of the top end of the stepped portion in the tank is set to be relatively large, without interfering with the throat pipe-side connecting portion. The watertight connection operation in the operating region surface of the top end of the stepped portion can thus be facilitated.

Also, the front region plane on the top end of the stepped portion in the tank can be made relatively small, so that dead space in the tank can be minimized. Therefore the tank as a whole can be reduced in size.

In the present invention, preferably, the top end of the stepped portion includes an operating area surface capable of the watertight connection operation; and wherein with the tank assembled from the top side of the predetermined installation position, the seal member, the tank-side connecting portion, and the toilet main unit-side connecting portion are respectively disposed to mutually overlap in a vertical downward direction of the stepped portion; and the watertight connection operation is a push-in operation in which when the tank is assembled from above to the predetermined installation position, the operating area surface is pushed downward by a worker, and the stepped portion is configured to enable the watertight connection between the tank and the toilet main unit by the push-in operation so as to push the tank-side connecting portion through the seal member into the toilet main unit-side connecting portion.

According to the invention thus constituted, a pushing-in operation by a worker is performed on the operating area surface on the stepped portion inside the tank when the tank is assembled from above to a predetermined installation position. When this happens, a pushing-in force is efficiently applied to the seal member, the tank-side connecting portion, and the toilet body-side connecting portion overlapping one another in the direction vertically below this stepped portion, thereby securely connecting them to one another in a watertight manner.

A relatively small force therefore suffices as the push-in force when connecting the seal member, tank-side connecting portion, and toilet body-side connecting portion in a watertight manner. Hence it is also possible to reduce the force applied directly by the push-in operation on the stepped portion. Therefore the tank as whole can also be reduced in size.

The invention preferably further comprises a force dispersion portion configured to enable support of the toilet main unit-side connecting portion so as to disperse the pushing-in force action on the toilet main unit-side connecting portion from the tank-side connecting portion when the tank is assembled to a predetermined installation position from above, and the operating area surface of the top end of the stepped portion is pushed downward.

According to the invention thus constituted, a push-in operation is conducted to push the tank-side connecting portion downward relative to the toilet main unit-side connecting portion from above, and the push-in force can be dispersed by a force dispersing portion if excessive push-in force is applied from the tank-side connecting portion to the toilet main unit-side connecting portion. Therefore breakage of the toilet main unit-side connecting portion can be prevented.

According to the flush toilet of the present invention, even when the areas surrounding the toilet main unit-side connecting portion and the tank-side connecting portion are respectively covered, thereby disabling direct access by workers, the tank can be easily connected to the toilet main unit in a watertight manner.

BRIEF DESCRIPTION OF THE DRAWINGS

FIG. 19B is a schematic cross section showing a first installation state, wherein after the pre-installation start state shown in FIG. 19A and before the flush water tank apparatus reservoir tank in a flush toilet according to a fourth embodiment of the invention is assembled from behind to a predetermined installation position on the rear side of the toilet main unit, only a spud is connected in a watertight manner to the inlet of the conduit of the toilet main unit.

DETAILED DESCRIPTION

Next, referring to the attached drawings, a flush toilet according to a first embodiment of the invention is explained.

First, using FIGS. 1-6, the basic structure of a flush toilet according to a first embodiment of the invention is explained.

Figure 1:
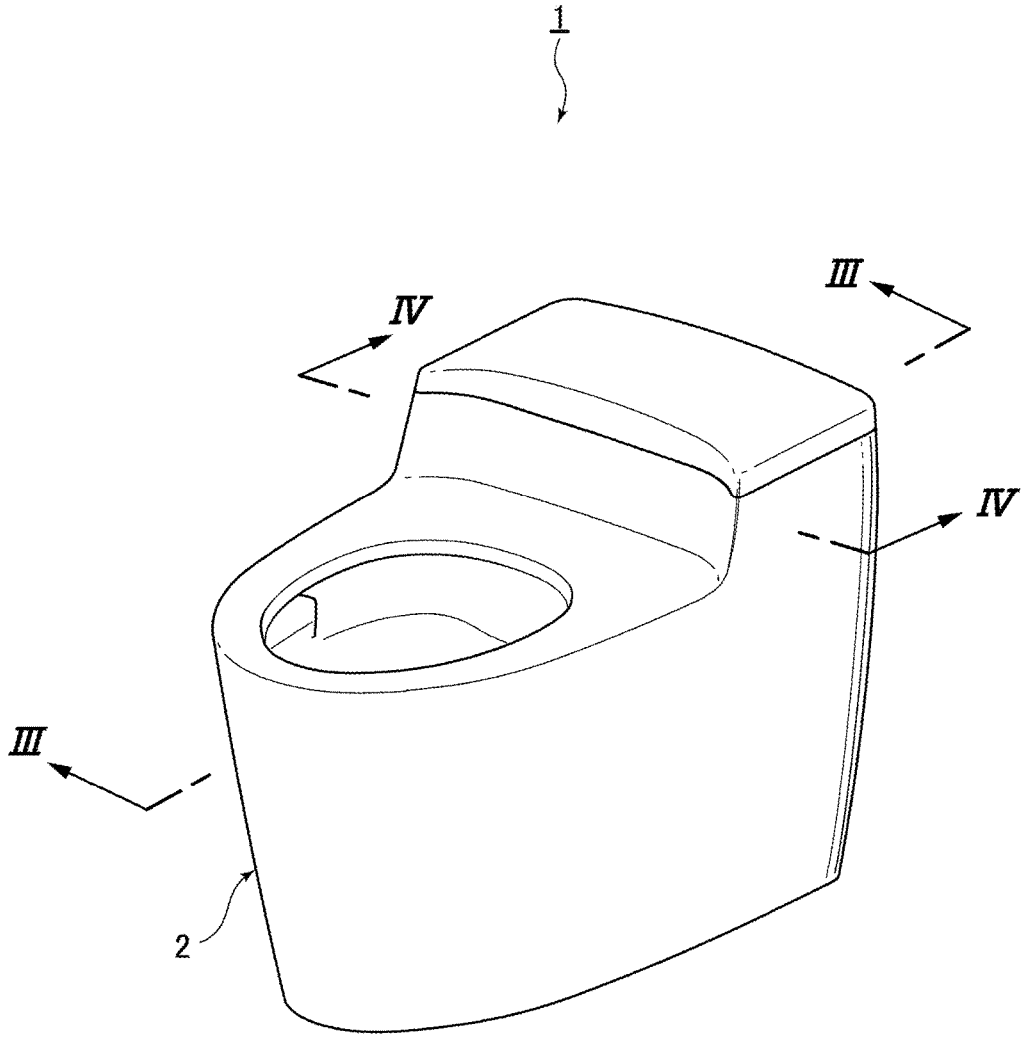
FIG. 1 is a schematic perspective view of a flush toilet according to a first embodiment of the invention.
Figure 2:
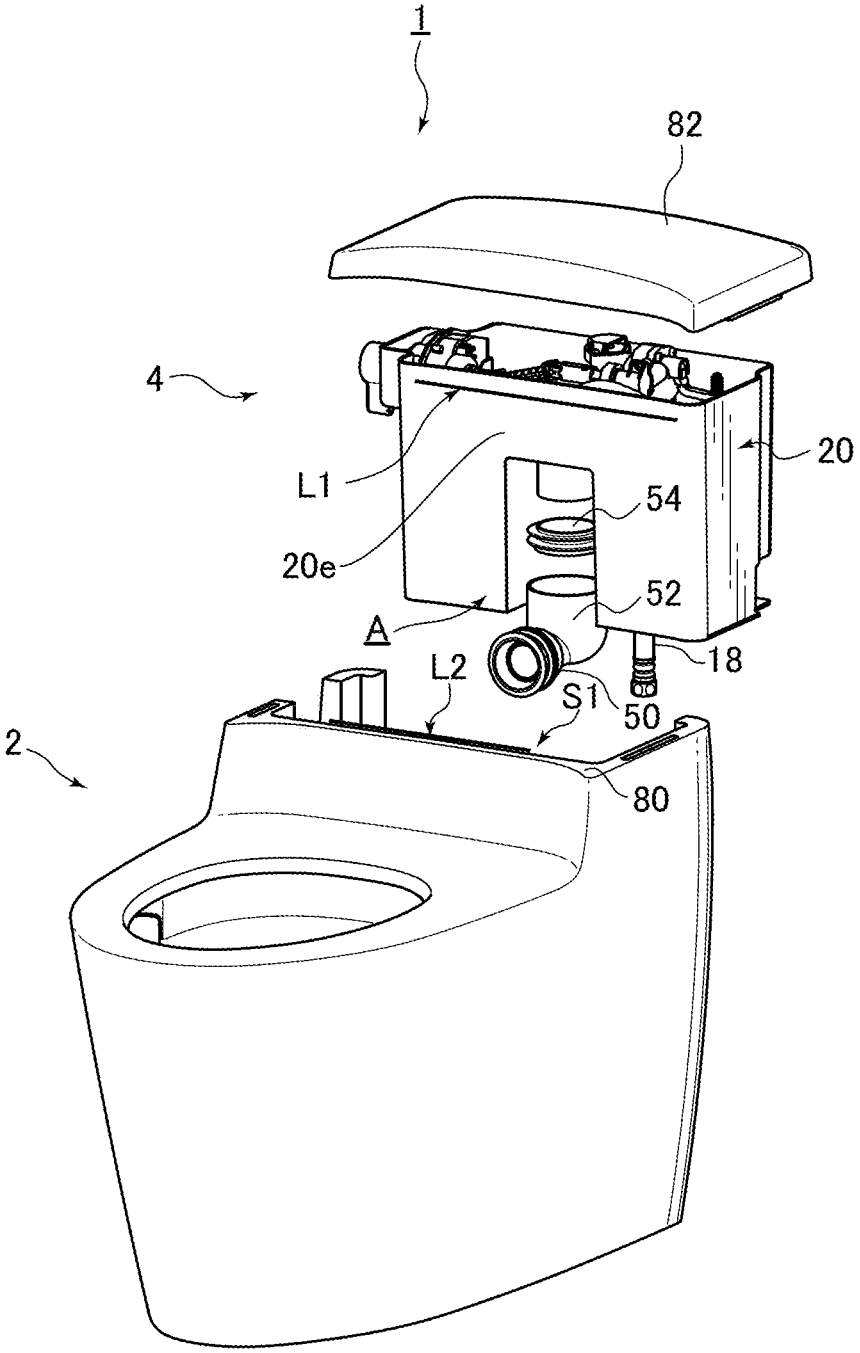
FIG. 2 is an exploded perspective view of a flush toilet according to a first embodiment of the invention.

FIG. 1 is a schematic perspective view of a flush toilet according to a first embodiment of the invention. Also, FIG. 2 is an exploded perspective view of a flush toilet according to a first embodiment of the invention. In addition, FIG. 3 is a center cross section seen along line III-III in FIG. 1.

Figure 3:
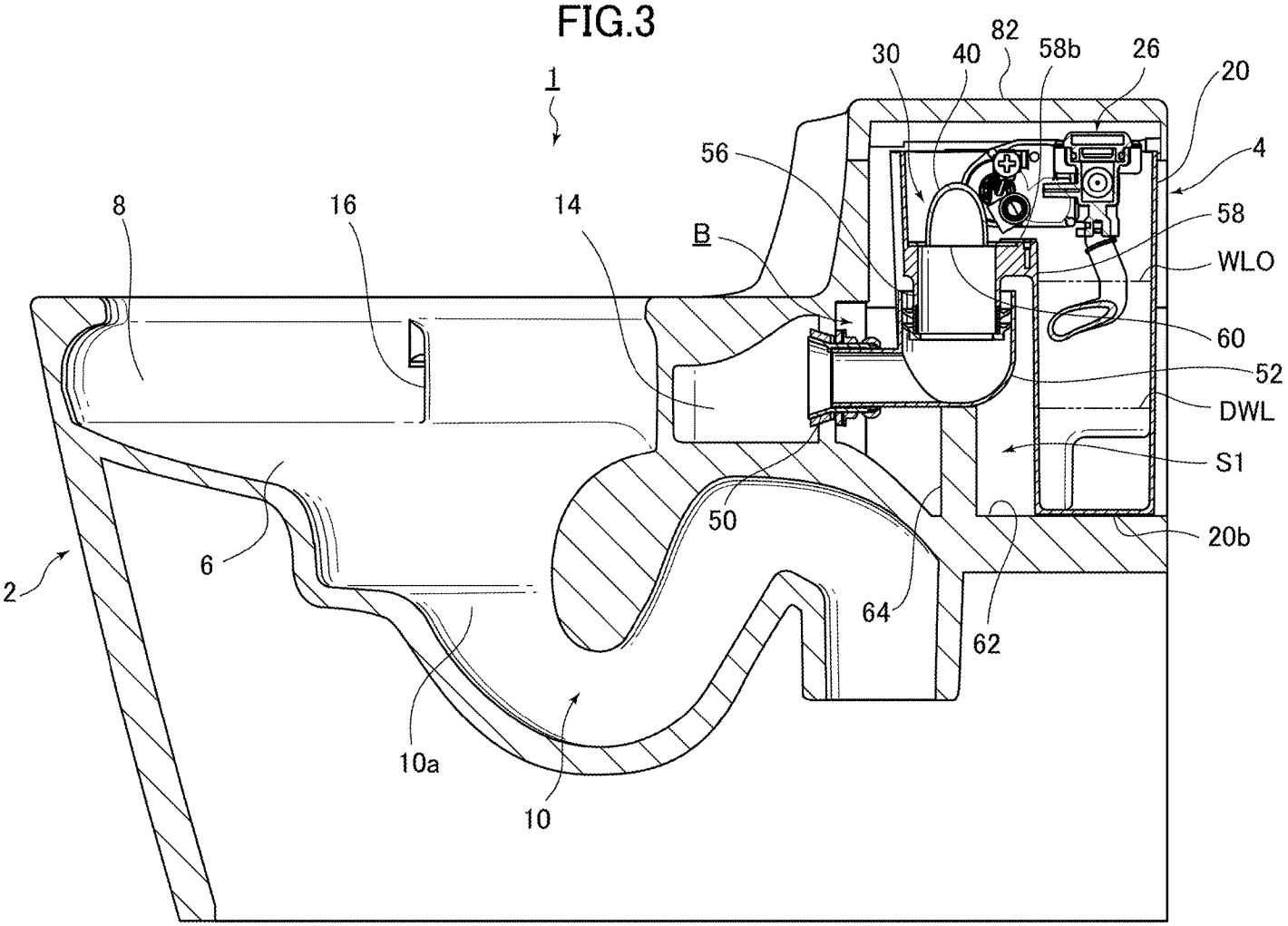
FIG. 3 is a center cross section seen along line III-III in FIG. 1.

First, as shown in FIGS. 1-3, the flush toilet 1 according to a first embodiment of the invention comprises a ceramic toilet main unit 2 and a flush water tank apparatus 4. This flush water tank apparatus 4 is installed at a predetermined installation position on the rear side of the toilet main unit 2, and supplies flush water to the toilet main unit 2. The flush toilet 1 is a water conserving wash-down type toilet which flushes with, for example, 6.0 liters of flush water, and preferably with 3.0-4.8 liters of flush water.

Next, as shown in FIG. 3, the toilet main unit 2 comprises, on its front side, a bowl 6 for receiving waste and a rim portion 8 formed at the top edge of this bowl 6.

An inlet 10*a* of a discharge trap pipe path 10 is opened on the bottom of the bowl 6 of the toilet main unit 2. After extending diagonally downward and to the rear side from this inlet 10*a*, the discharge trap pipe path 10 extends diagonally upward and to the peak portion on the rear side; thereafter it extends downward and is connected to a discharge socket (not shown) installed on the floor surface.

As shown in FIG. 3, a conduit 14 for guiding flush water supplied from the flush water tank apparatus 4 to the bowl 6 is formed from the rear side of the bowl 6 of the toilet body 2 to the inside of the rim portion 8 on the side. In addition, a spout port 16, from which flush water in this conduit 14 is spouted, is formed on a part of the bowl 6.

Note that in the flush toilet 1 according to the embodiment the form of a wash-down type toilet for discharging waste using the gravity drop in the height direction is explained. However the invention may also be a siphon toilet in which siphon action is used to draw in waste in the bowl 6 and discharge it all at once from the discharge trap pipe path 10. Or it may be applied to toilets of other forms.

In a flush toilet 1 according to the embodiment, discharge water discharged from the discharge trap pipe path 10 is discharged to a discharge pipe path (not shown), but a discharge socket (not shown) may also be used. A form in which a socket (not shown) for discharging water discharged from the discharge trap pipe path 10 to a discharge pipe path (not shown) on the reverse side of a wall behind the flush toilet 1 is also acceptable.

Next, referring to FIGS. 1 through 8, details of the flush water tank apparatus 4 are explained.

Figure 4:
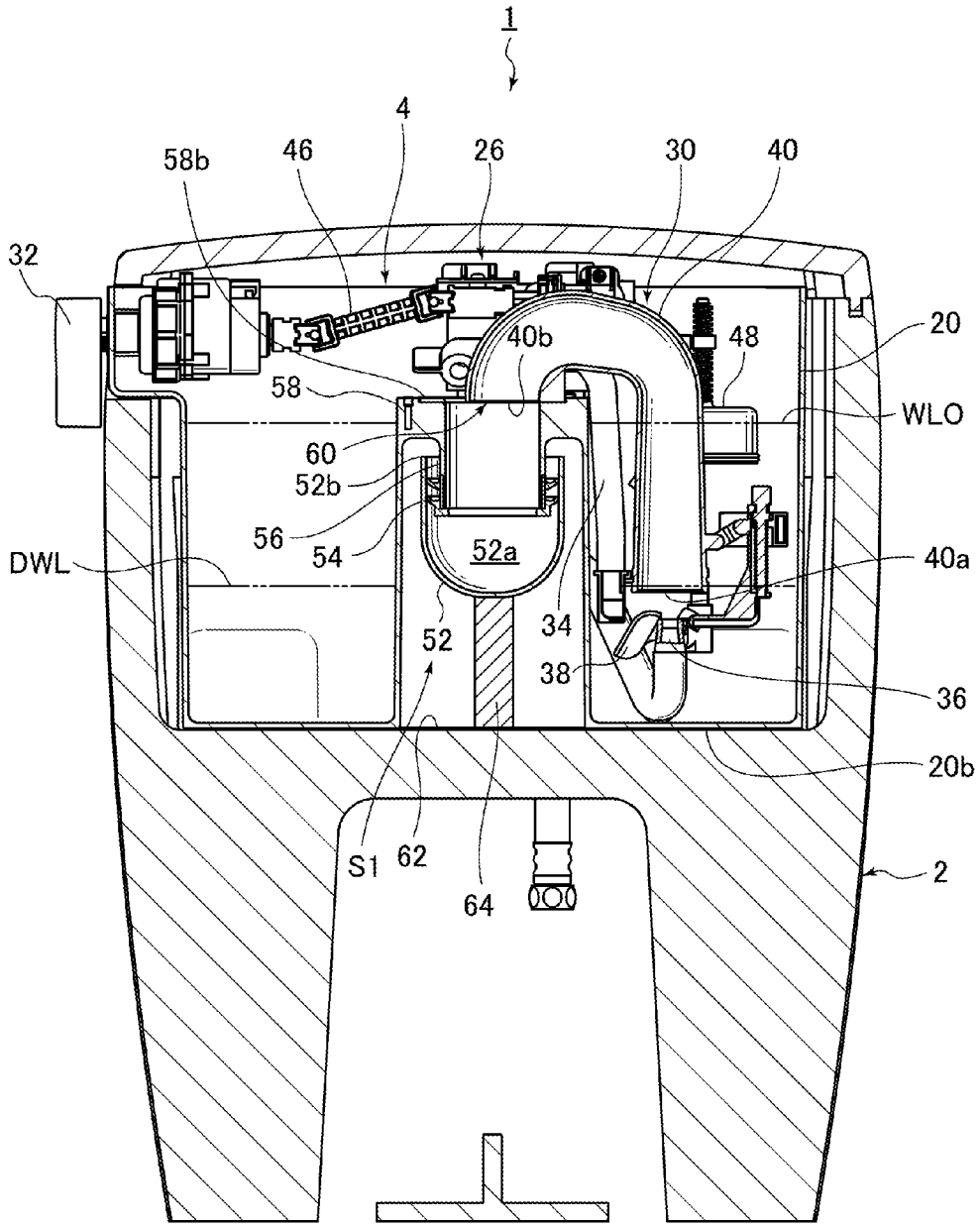
FIG. 4 is a front elevation cross section seen along line IV-IV in FIG. 1.
Figure 5:
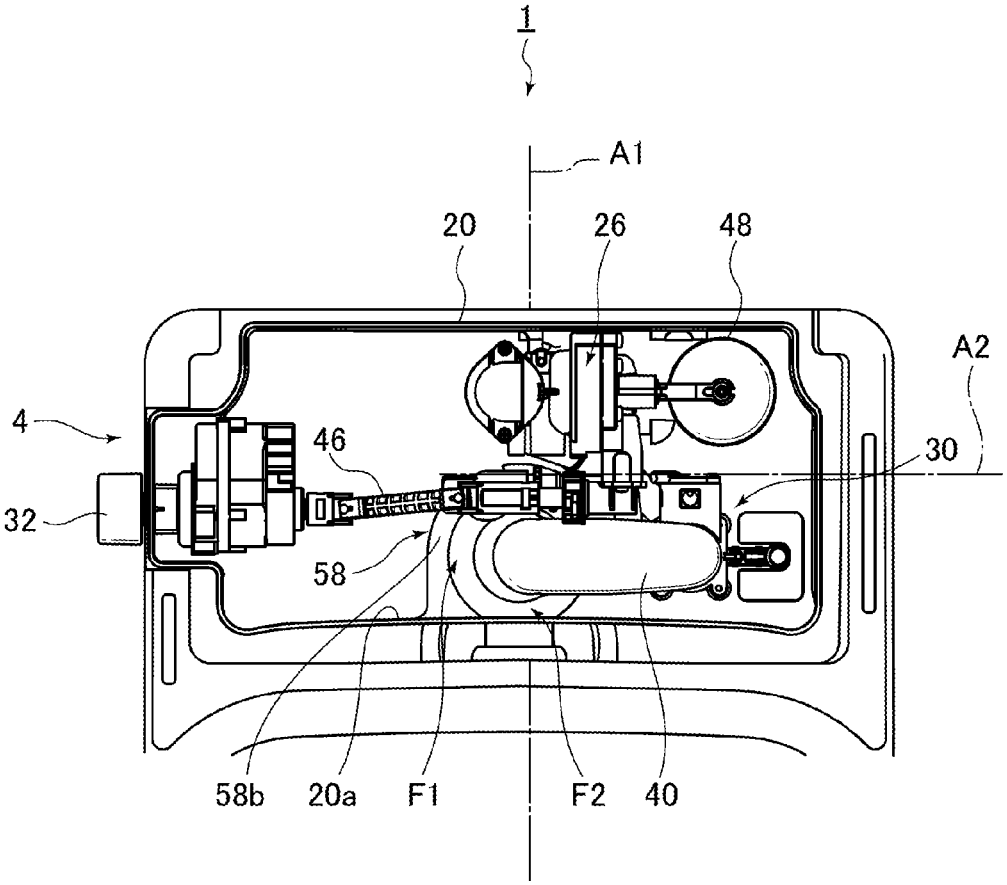
FIG. 5 is a plan view showing the internal structure of a flush water tank apparatus in a flush toilet according to a first embodiment of the invention.
Figure 6:
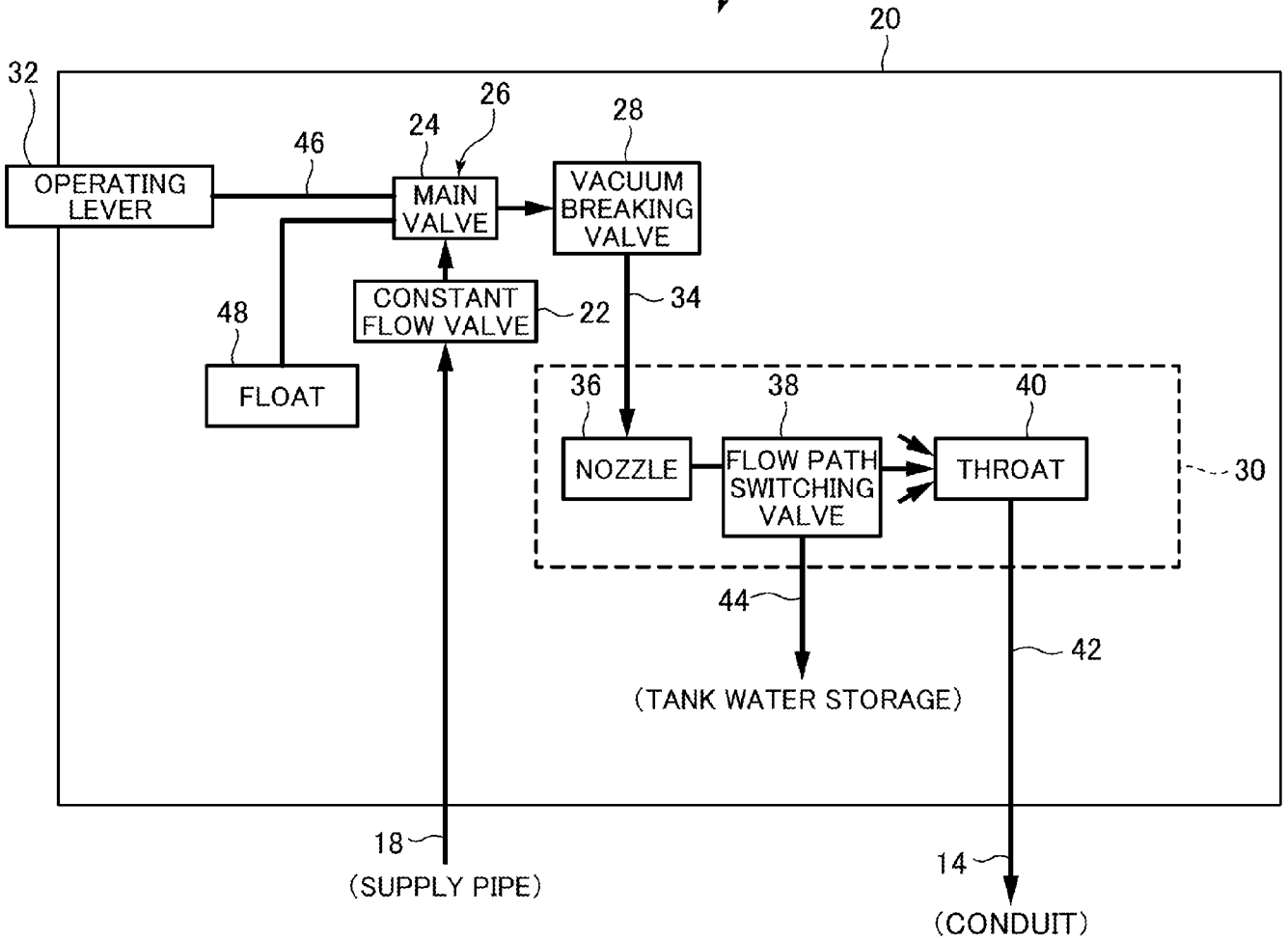
FIG. 6 is a block diagram showing the basic constitution of a flush toilet flush water tank apparatus according to a first embodiment of the invention.

FIG. 4 is a front elevation cross section seen along line IV-IV in FIG. 1. FIG. 5 is a plan view showing the internal structure of a flush water tank apparatus in a flush toilet according to a first embodiment of the invention. In addition, FIG. 6 is a block diagram showing the basic constitution of a flush toilet flush water tank apparatus according to a first embodiment of the invention.

Note that with respect to the left-right direction in the flush water tank apparatus 4 shown in FIGS. 4 and 5, the left side in the left-right direction as seen from the front of the toilet main unit 2 is defined as the "left side," and the right side in the left-right direction as seen from the front of the toilet main unit 2 is defined as the "right side".

As shown in FIGS. 2-6, the flush water tank apparatus 4 comprises a supply pipe 18, the upstream side of which is connected to a water supply source (not shown) such as a water utility, and a reservoir tank 20. This reservoir tank 20 is assembled from above into a predetermined installation space S1 to the rear of the bowl 6 of the toilet main unit 2. A portion of flush water supplied from the water supply source (not shown) through the supply pipe 18 is stored in the reservoir tank 20, which functions as a tank for supplying flush water to the conduit 14 of the toilet main unit 2.

Also, as shown in FIG. 5, the reservoir tank 20 is formed as an elongated flat shape in the left-right direction when seen in plan view. In addition, the reservoir tank 20, as shown in FIG. 3, is what is known as a low silhouette type of reservoir tank, disposed at a relatively low position on the rear side of the toilet main unit 2, with the top edge height of the reservoir tank 20 at a low position.

Furthermore, in the flush toilet 1 of the embodiment the toilet main unit 2 is constituted so that when the reservoir tank 20 is assembled into a predetermined installation space S1 (see FIG. 2) on the rear side of the conduit 14, the reservoir tank 20 must be assembled by insertion from the upper side, which is left open on this installation space S1.

Irrespective of on-site installation of the flush toilet 1, the flush toilet 1 of the embodiment can basically be used in on-site installation or various other conditions once the reservoir tank 20 is inserted and assembled in a factory from above relative to the predetermined installation space S1, which is left open to the rear of the bowl 6 on the toilet main unit 2.

Next, as shown in FIGS. 3-6, a supply valve apparatus 26 including a main valve 24, is installed inside the reservoir tank 20. This supply valve apparatus 26 functions as a supply valve for supplying and cutting off flush water supplied from the supply pipe 18 through a constant flow valve 22. A jet pump unit 30 (details below) connected though a vacuum-breaking valve 28 to the downstream side of the supply valve apparatus 26 inside the reservoir tank 20 is fitted within the downstream side of the supply valve apparatus 26 inside the reservoir tank 20.

Also, as shown in FIGS. 4-6, the flush water tank apparatus 4 comprises an operating lever 32, placed on the left side portion of the reservoir tank 20 as seen from the front side of the toilet main unit 2, for controlling the operation of the supply valve apparatus 26.

Next, as shown in FIGS. 4 and 6, the jet pump unit 30 comprises, within the reservoir tank 20, a jet nozzle 36, at least part of which is submerged in water. The jet nozzle 36 is able to jet flush water supplied from the supply pipe 34 extending from a vacuum-breaking valve 28. Here, the vacuum-breaking valve 28 draws in air from outside and functions to prevent a negative pressure from occurring inside the supply pipe 34 from the vacuum-breaking valve 28 to the jet nozzle 36.

As shown in FIGS. 4 and 6, the jet pump unit 30 comprises a flow path switching valve 38 disposed close to the downstream side of the jet nozzle 36. The flow path switching valve 38 is capable of switching the pathway for flush water jetted from the jet nozzle 36 in response to the water level inside the reservoir tank 20.

In addition, as shown in FIGS. 3-6, the jet pump unit 30 comprises a throat pipe 40. An intake port 40*a* is formed at one end of this throat pipe 40. An outlet 40*b* permitting flush water to flow out is formed on the other end of the throat pipe 40. The throat pipe 40, as shown in FIG. 4, is arranged so that the pipe shape of the throat pipe 40 from the intake port 40*a* thereof to the outlet 40*b* is formed as a reverse U, for example (or, worded differently, as a reverse J, or a gooseneck).

The jet nozzle 36 is disposed to face the intake port 40*a* of the throat pipe 40. The intake port 40*a* of the throat pipe 40 and the jet nozzle 36 are always submerged in the reservoir tank 20.

As shown in FIG. 6, the flow path switching valve 38 is able to switch between either the toilet flushing flow path 42 or the tank water storage flow path 44 in response to the water level inside the reservoir tank 20.

The toilet flushing flow path 42 allows flush water jetted from the jet nozzle 36 when the bowl 6 of the toilet body 2 is flushed to flow into the throat pipe 40 from the intake port

40*a* of the throat pipe 40, then allows it to flow from the outlet 40*b* to the toilet main unit 2 conduit 14 side.

The tank water storage flow path 44 is directed into the reservoir tank 20 on the outside of the throat pipe 40 so as to allow flush water jetted from the jet nozzle 36 to flow into the throat pipe 40 when water is stored in the reservoir tank 20. Thus if a flow path switching valve 38 is placed on the toilet flushing flow path 42, the jet nozzle 36 jets flush water from the throat pipe 40 intake port 40*a* toward the interior. This induces a jet pump action for increasing the flow volume of flush water flowing through the throat pipe 40 more than the flow volume of flush water jetted from the jet nozzle 36. The increased flow volume of flush water is thereby supplied from the throat pipe 40 outlet 40*b* toward the conduit 14 of the toilet main unit 2.

I. e., the term "jet pump action" set forth in this Specification means that a powerful flow of flush water jetted from the jet nozzle 36 toward the throat pipe 40 intake port 40*a* itself forms a negative pressure, drawing in the flush water around the throat pipe 40 intake port 40*a* without depending on a pump or other mechanical means. In addition, jet pump action means the action of conveying flush water inside the reservoir tank 20, drawn into the throat pipe 40 using this negative pressure, to the toilet main unit 2 side.

As shown in FIGS. 4-6, the supply valve apparatus 26 is the same as in the past relative to its structure and operating mechanisms, therefore a specific explanation thereof is omitted. Also, the main valve 24 is a pilot type of diaphragm valve, and is connected to the operating lever 32 by a drive shaft 46.

The main valve 24 can be opened and closed by the motion of a first pilot valve (not shown), in turn opened and closed by manipulating the operating lever 32.

In addition, the main valve 24 can also be opened and closed by the motion of a second pilot valve (not shown), opened and closed by the up and down movement of a float 48, which moves up and down with the flush water level inside the supply valve apparatus 26.

Figure 8:
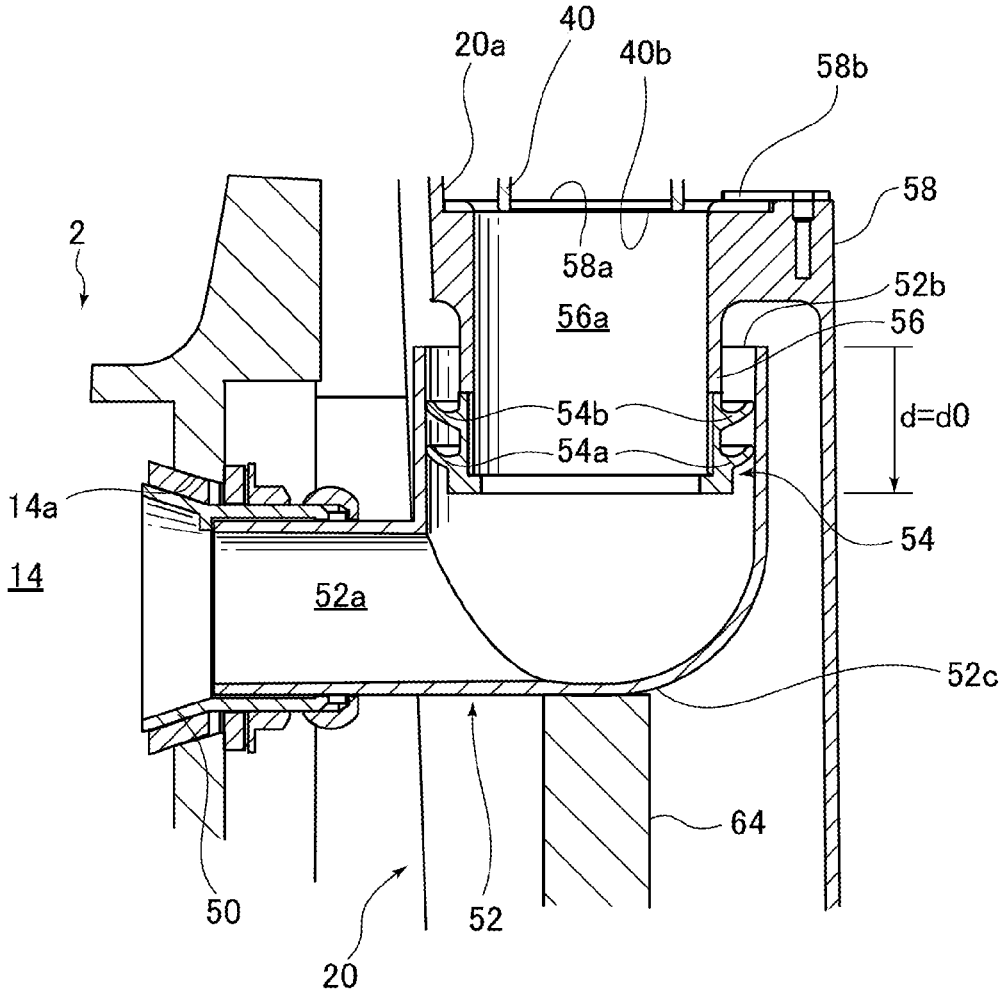
FIG. 8 is an expanded view of part B in FIG. 3.

Next, FIG. k 7 is an expanded diagram of FIG. 2, part A; FIG. 8 is an expanded diagram of FIG. 3, part B.

As shown in FIGS. 2-4, 7, and 8, a spud 50, being a part of the toilet main unit-side connecting portion, is connected in a watertight manner to the inlet 14*a* of the conduit 14 of the toilet main unit 2. One end of the connecting pipe member 52, which is part of the toilet main unit-side connecting portion, is inserted in a watertight manner from its rear side into this spud 50.

Also, as shown in FIGS. 2-4, 7, and 8, the connecting pipe member 52 forms a toilet main unit-side connecting pipe path 52*a*. This toilet main unit-side connecting pipe path 52*a* extends from one end portion (the front end portion) connected in a watertight manner to the spud 50, then becomes a curved pipe path pointing to the upward side. Then the other end portion (top end 52*b*) of this connecting pipe member 52 forms an opening end penetrating in the vertical direction.

In addition, an essentially ring fin packing 54, being a seal member, is inserted from above into the connecting pipe path 52*a* and connected in a watertight manner to the top end 52*b* of the connecting pipe member 52.

A tank-side connecting portion 56 formed in essentially a ring shape as a single piece with the reservoir tank 20 is inserted and connected in a watertight manner to the inside circumference side of this fin packing 54. A tank-side connecting pipe path 56*a* is formed on the inside of the tank-side connecting portion 56.

In the present embodiment the form is explained in which the spud 50 and connecting pipe member 52, being toilet main unit-side connecting portions to the conduit 14 of the toilet main unit 2, are respectively formed as separate bodies. However, without limitation to such forms, the spud 50 and connecting pipe member 52 parts, being the toilet main unit-side connecting portion, may also be formed of a single body of the same ceramic or the like relative to the conduit 14 of the toilet main unit 2.

In the present embodiment a form is explained in which a fin packing 54 is employed as a seal member mounted in a watertight manner between the connecting pipe member 52 and the tank-side connecting portion 56. However, as a variant example, it is also acceptable to use a ring packing, O-ring, or the like instead of a fin packing. In this case, the seal member is placed in advance between the toilet main unit-side connecting portion and the tank-side connecting portion, such as at the bottom surface of the connecting member 58 connecting port 58*a*. The connecting portion between the toilet main unit-side connecting portion and the tank-side connecting portion is tightened from both above and below using a bolt and nut as connecting portion. In this way, the toilet main unit-side connecting portion and tank-side connecting portion may also be connected in a watertight manner.

Moreover, in the present embodiment it is explained that the essentially cylindrical tank-side connecting portion 56 is formed as a single body with the reservoir tank 20. However, it may also be separate cylindrical member from the reservoir tank 20.

Next, as shown in FIGS. 3-5, 7, and 8, the reservoir tank 20 comprises on its interior a stepped portion 58 formed in a single piece at the center in the left-right direction at the front thereof. This stepped portion 58 projects from the front surface (inside front surface 20*a*) toward the rear side and extends upward from the bottom surface 20*b*. The stepped portion 58 is formed to surround the side of the cylindrical tank-side connecting portion 56 and the outer circumferential part on its rear side.

Next, as shown in FIGS. 3-5, 7, and 8, the reservoir tank 20 stepped portion 58 comprises a top end 58*b* on which a connecting port 58*a* is formed. A throat pipe-side connecting portion 60 forming the outlet 40*b* of a throat pipe 40 is connected to the connecting port 58*a* of the top end 58*b*. By this means, the throat pipe 40 pipe path and the tank-side connecting pipe path 56*a* communicate. The top end 58*b* of this stepped portion 58, as shown in FIGS. 4 and 5, is positioned above full water level WL0 inside the reservoir tank 20. By this means, when the reservoir tank 20 is assembled from the top side into a predetermined installation space S1 further to the rear side than the bowl 6 of the toilet main unit 2, a worker can perform a pushing in operation from the top downward as a watertight connecting operation to connect the top end 52*b* of the connecting pipe member 52 and tank-side connecting portion 56, serving as the toilet main unit-side connecting portion, in a watertight manner through the fin packing 54.

Figure 7:
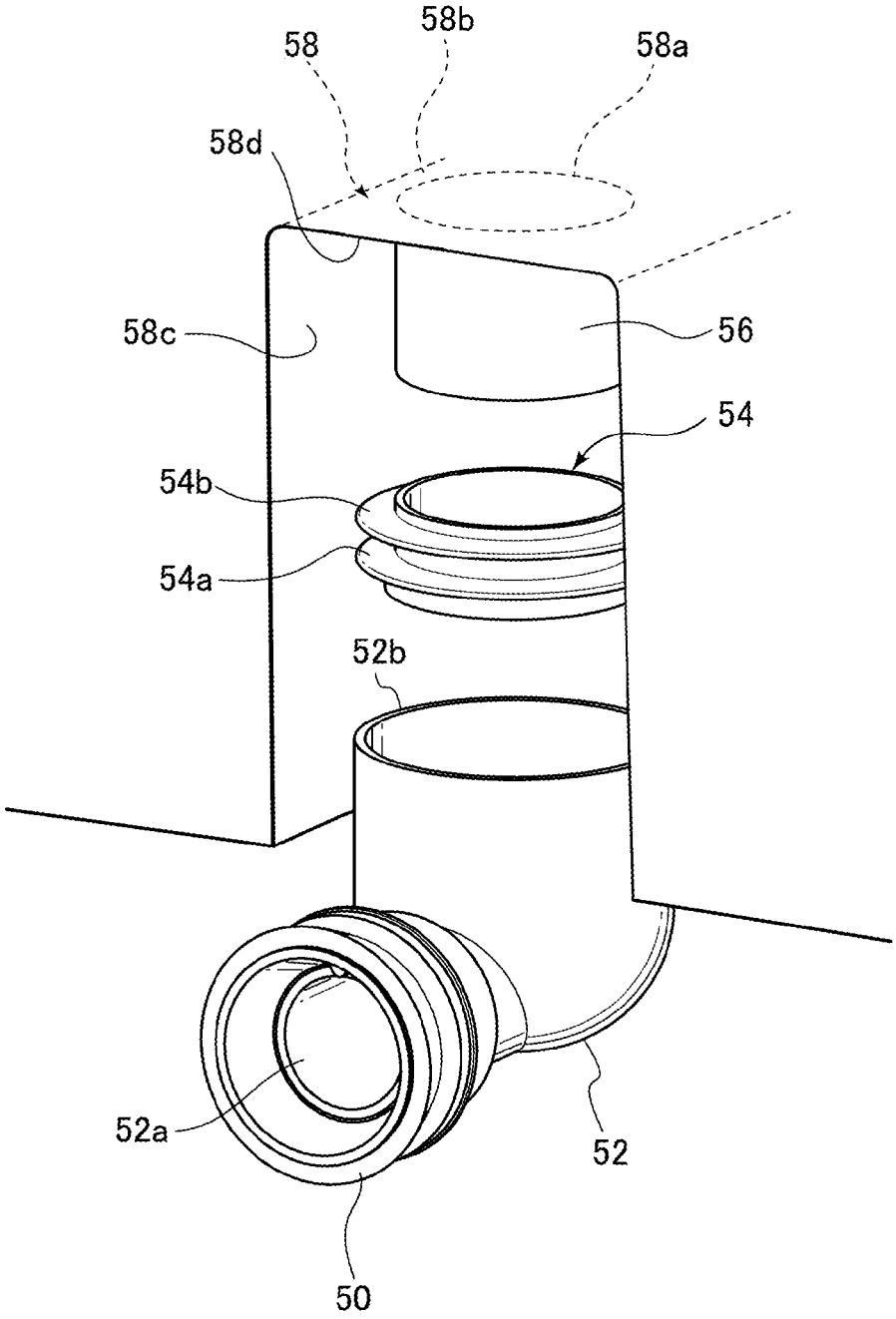
FIG. 7 is an expanded view of part A in FIG. 2.

Next, as shown in FIGS. 3-5, 7, and 8, on the spud 50 and connecting pipe member 52, being the toilet main unit-side connecting portion, as well as the tank-side connecting portion 56, when the reservoir tank 20 is connected in a watertight manner to the toilet main unit 2, the left and right sides and the rear side of the these parts 50, 52, and 56 are covered by the stepped portion 58 outside wall portion 58*c* (see FIG. 7). In addition, the top sides of these parts 50, 52, and 56 are covered by a top side wall portion 58*d* (see FIG. 7). The front sides and bottom sides of these parts 50, 52, and 56 are covered by the toilet main unit 2. Therefore the areas around these parts 50, 52, and 56, i.e., the front and back, top and bottom, and left and right of these parts 50, 52, and 56 are covered so as not to be directly accessible by workers.

Note that in the flush toilet 1 of the present embodiment the stepped portion 58 projects toward the rear side from the front surface (inside front surface 20*a*) inside the reservoir tank 20. In addition, the stepped portion 58 extends upward from the bottom surface 20*b*, and is formed to surround the side of the cylindrical tank-side connecting portion 56 and the outer circumferential part on the rear side thereof. A form is explained in which the sides of the tank-side connecting portion 56 are thus covered by the reservoir tank 20, making it inaccessible to workers. Without limit to such forms, however, as another form in which covering prevents direct access by workers, the sides of the tank-side connecting portion 56 may be covered by both a part of the toilet main unit 2 and a part of the reservoir tank 20.

Also, the meaning of the word "covered" in the phrase "covered so as to prevent direct access by workers" includes the meaning of gaps too small for a worker's hand to fit (access).

Also, as shown in FIGS. 3 and 4, several stepped portions are formed inside the reservoir tank 20. In particular, the stepped portion 58 is the only stepped portion positioned above the lowest water level (the dead water level DWL) inside the reservoir tank 20 among the stepped portions inside the reservoir tank 20.

Next, as shown in FIG. 5, the reservoir tank 20 stepped portion 58 is formed at the center portion in the left-right direction at the front side inside the reservoir tank 20. The stepped portion 58 is thus positioned over center axial line A1, dividing the reservoir tank 20 into two parts in the left-right direction. In addition, the stepped portion 58 is positioned to the front of a center axial line A2 dividing the reservoir tank 20 into two parts in the front to back direction.

At the same time, as shown in FIG. 5, the supply valve apparatus 26 and throat pipe 40 are respectively disposed more to one side in the left-right direction inside the reservoir tank 20 than the other side. Thus the action of pushing in a part of the top end 58*b* of the stepped portion 58 from the top downward becomes possible when the reservoir tank 20 is assembled from above to a predetermined installation position on the rear side of the toilet main unit 2.

More specifically, as shown in FIG. 5, in the reservoir tank 20 the supply valve apparatus 26 is disposed to the right of the center axial line A1 which equally divides the reservoir tank 20 into two parts along the left-right direction as seen in plan view. The supply valve apparatus 26 is disposed more to the rear side of the center axial line A2 dividing the reservoir tank 20 into two equal parts in the front-back direction as seen in plan view.

As shown in FIG. 5, inside the reservoir tank 20 the throat pipe 40 is disposed to the right side of the center axial line A1 which equally divides the reservoir tank 20 into two parts along the left-right direction as seen in plan view. In addition, the throat pipe 40 is disposed more to the front side of the center axial line A2 dividing the reservoir tank 20 into two equal parts in the front-back direction as seen in plan view.

Next, as shown in FIG. 5, the top end 58*b* of the stepped portion 58 includes an operating area surface F1 and a front area surface F2. The operating area surface F1 is formed in the area on one side in the left-right width direction of the top end 58*b* of the stepped portion 58, and can be pushed in without interfering with the throat pipe-side connecting portion 60. The front area surface F2 is formed between the throat pipe-side connecting portion 60 and the inside front surface 20*a*, being the front wall portion inside the reservoir tank 20 adjacent thereto, and is set to be smaller than the surface area of the operating area surface F1.

Note that in the present embodiment, as shown in FIG. 5, a form is explained in which the operating area surface F1, which can be pushed in without interfering with the throat pipe-side connecting portion 60, is formed in an area on one side in the left-right width direction of the top end 58*b* of the stepped portion 58. However the operating area surface F1 may be formed in areas on both sides in the left-right width direction of the top end 58*b* on stepped portion 58.

Next, as shown in FIG. 8, the top end 52*b* of the connecting pipe member 52 serving as toilet main unit-side connecting portion, the fin packing 54 serving as seal member, and the tank-side connecting portion 56 are respectively disposed to mutually overlap the stepped portion 58 in the vertical downward direction, with the reservoir tank 20 assembled from above to a predetermined installation position on the rear side of the toilet main unit 2. The downward insertion of the operating area surface F1 results in the tank-side connecting portion 56 being pushed through the fin packing 54 into the connecting pipe path 52*a* from the top end 52*b* of the connecting pipe member 52. The fin packing 54 is then inserted from the top end 52*b* of the connecting pipe member 52 into the connecting pipe path 52*a*. The watertight connection between the reservoir tank 20 and the toilet main unit 2 is complete when the insertion state is such that the inserted distance d equals a predetermined insertion distance d0.

Note that in the present embodiment the form is explained wherein, when a reservoir tank 20 is assembled from above to a predetermined installation space S1 on the rear side of the bowl 6 of the toilet body 2, a worker can perform the operation of pushing the operating area surface F1 on the top end 58*b* of the stepped portion 58 on the reservoir tank 20 downward from above, as one example of the form in which a worker performs a watertight connection operation to connect the top end 52*b* of a connecting pipe member 52, being a toilet main unit-side connecting portion, to a tank-side connecting portion 56 through a fin packing 54. However it is also acceptable to perform the above-described waterproof connecting operation by an operation other than the pushing-in operation, such as by affixing the top end 52*b* of the connecting pipe member 52 and the tank-side connecting portion 56 through a seal member with a tightening member or the like.

Next, as shown in FIGS. 3, 4, and 8, a ceramic force dispersion portion 64 is integrally formed on the bottom surface 62 of the installation space S1 in which the reservoir tank 20 is installed at the rear side of the toilet main unit 2. This force dispersion portion 64 extends upward in a columnar shape to the vicinity of the bottom surface 52*c* of the bent portion of the connecting pipe member 52.

With the reservoir tank 20 assembled from above to a predetermined installation position, when the operating area surface F1 on the top end 58*b* of the stepped portion 58 is pushed down, this force dispersion portion 64 is able to support, on the toilet main body 2 side, the bottom surface 52*c* on the bent portion of the connecting pipe member 52 serving as toilet main unit-side connecting portion. The pushing in force imparted from the tank-side connecting portion 56 to the connecting pipe member 52 can thus be dispersed.

Note that in the present embodiment the form is explained in which the force dispersion portion 64 is formed as one piece with the toilet main unit 2. However a form is also acceptable in which the force dispersion portion 64 is formed as a one piece with the connecting pipe member 52, or in which the force dispersion portion is a separate body from the toilet main unit 2 or the connecting pipe member 52.

Next, as shown in FIGS. 7 and 8, lower fin portions 54*a* and upper fin portions 54*b*, being multiple flexible projecting portions projecting radially outward, are formed over the entire circumference of the outer circumferential surface of fin packing 54, which is a packing member formed in essentially a ring shape. The fin portions 54*a*, 54*b* are multiply arranged, spaced apart in the axial direction on the outer circumferential surface of the fin packing 54.

Using multiple lower fin portions 54*a* and 54*b* on the fin packing 54, watertightness can be securely assured even if the axial centers of the connecting pipe member 52 serving as the toilet-side connecting portion and the tank-side connecting portion 56 are mutually offset.

As shown in FIGS. 7 and 8, when the reservoir tank 20 is assembled from above to a predetermined installation position, the fin packing 54, being a seal member, is pushed into the toilet main unit-side connecting pipe path 52*a* of the connecting pipe member 52, together with the reservoir tank 20 tank-side connecting portion 56, thereby connecting the tank-side connecting portion 56 in a watertight manner to the connecting pipe member 52. However, the pushing-in force acting on the fin packing 54 at this time is set to be smaller than the pull-out force acting on the fin packing 54 when the tank-side connecting portion 56 connected in a watertight manner to the connecting pipe member 52 is pulled out and removed from the connecting pipe member 52.

Figure 9:
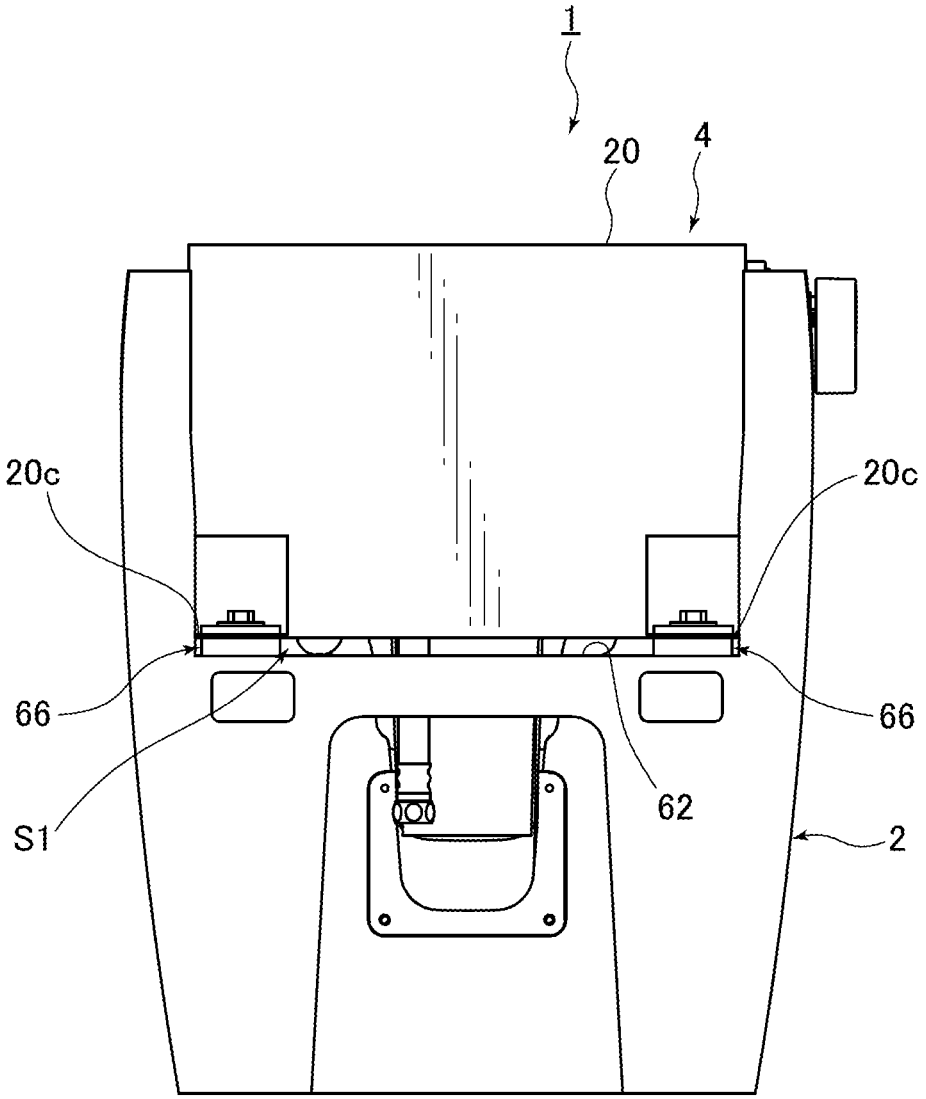
FIG. 9 is a rear elevation view of a flush toilet according to a first embodiment of the invention.

Next, FIG. 9 is a rear elevation view of a flush toilet according to a first embodiment of the invention.

As shown in FIG. 9, the flush toilet 1 of the present embodiment comprises a pair of affixing devices 66. With these affixing devices 66 and the flush water tank apparatus 4 reservoir tank 20 installed in a predetermined installation space S1, the base portion 20*c* at the rear surface side and on both the left and right sides of the reservoir tank 20 is an affixing portion affixed to the toilet main unit 2 so that a horizontal reservoir tank 20 orientation is maintained, and functions as a horizontal maintenance portion.

Figure 10:
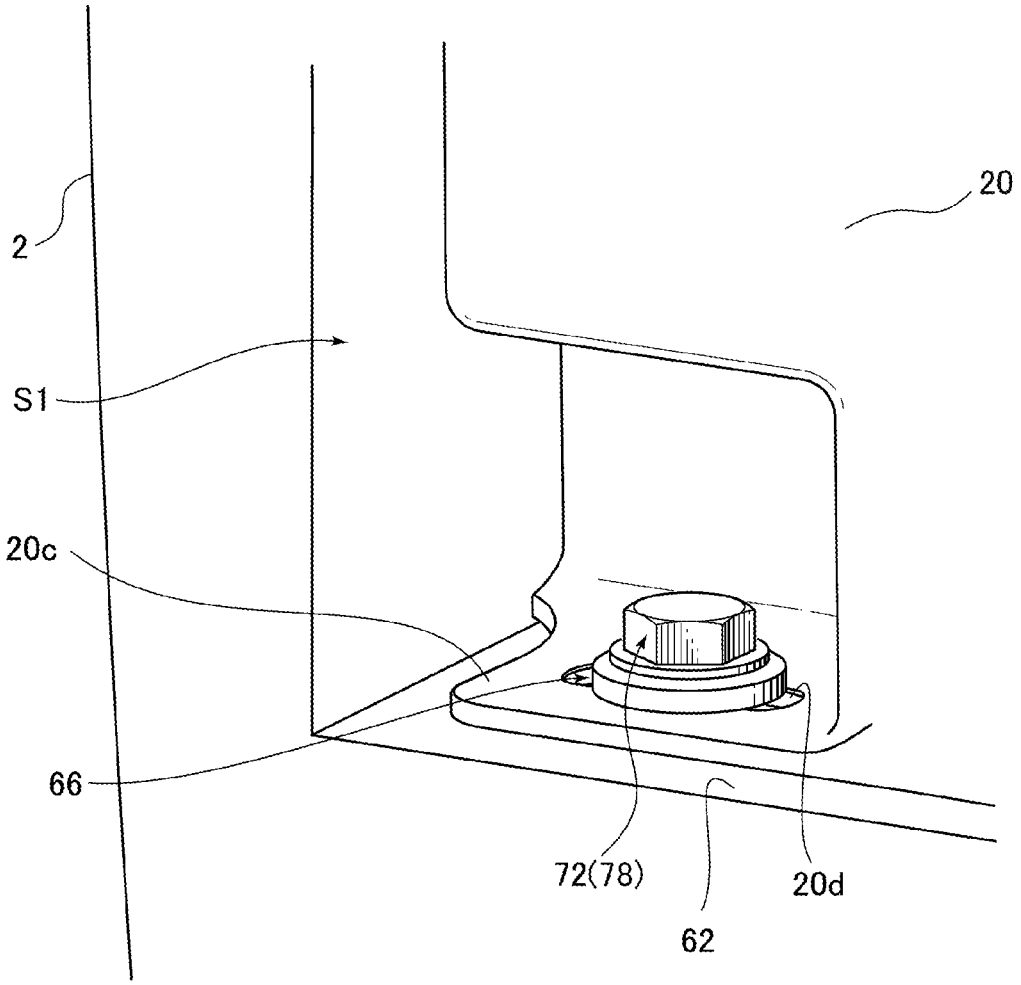
FIG. 10 is a schematic perspective view expanding the affixing apparatus affixing the reservoir tank on the flush water tank apparatus in the flush toilet according to the first embodiment of the invention shown in FIG. 9.

FIG. 10 is a schematic perspective view expanding the affixing apparatus affixing the reservoir tank on the flush water tank apparatus in the flush toilet according to the first embodiment of the invention shown in FIG. 9. Also, FIG. 11 is a schematic view of the affixing apparatus affixing the reservoir tank on the flush water tank apparatus in the flush toilet according to a first embodiment of the invention.

Figure 11:
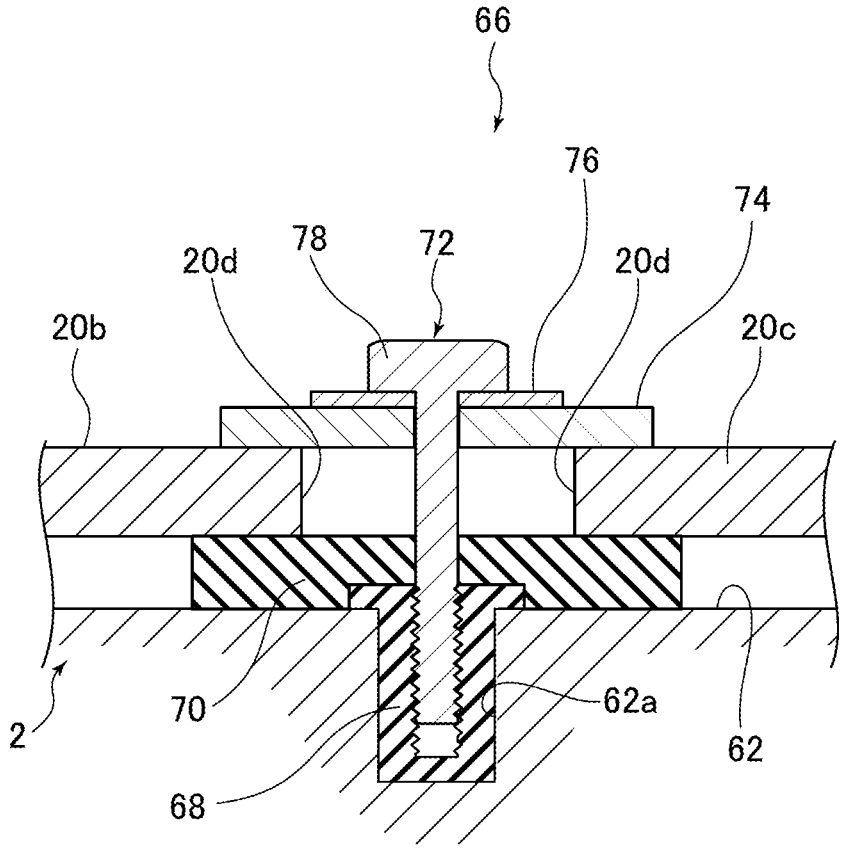
FIG. 11 is a schematic view of the affixing apparatus affixing the reservoir tank on the flush water tank apparatus in a flush toilet according to a first embodiment of the invention.

As shown in FIGS. 10 and 11, the affixing devices 66 comprise a rubber bushing 68, a flexible member 70, a bolt 72, and metal washers 74, 76.

Attachment of the rubber bushing 68 is by insertion into an attaching hole 62*a* on the bottom surface 62 of the reservoir tank 20 installation space S1 at the rear side of the toilet main unit 2.

The flexible member 70 is formed of a cushion or the like disposed inside a long hole 20*d* for affixing the tank, which vertically penetrates the reservoir tank 20 base portion 20*c*.

The bolt 72 is attached to the rubber bushing 68 through the flexible member 70.

The metal washer 74 is attached to this bolt 72, and the bottom surface thereof is capable of contacting the bottom surface 20*b* of the reservoir tank 20.

The spring washer 76 is attached to the bolt 72, and the bottom surface thereof is capable of contacting the top surface of the metal washer 74.

Also, a bolt operating portion 78, the bottom surface of which is able to contact the top surface of the spring washer 76, is formed as a single piece with the head (top end) of the bolt 72 so as to project radially outward.

In addition, the rubber bushing 68 also functions as a nut engaged by the lower part of the bolt 72.

These elements 68, 70, 72, 74, 76, and 78 function as a horizontal adjustment portion capable of adjusting the orientation of the reservoir tank 20 to a horizontal state.

Note that in the present embodiment, a form is explained in which the rubber bushing 68 and the flexible member 70 are mutually separate members. However the rubber bushing 68 and flexible member 70 may also be mutually formed as a single piece.

More specifically, as shown in FIGS. 9-11, with respect to the rubber bushing 68, after the reservoir tank 20 is assembled at a predetermined installation position on the rear side of the toilet main unit 2, the bolt operating portion 78 functions as an operating portion capable of a tightening operation. Thus the amount of elastic deformation when the flexible member 70 is compressed in the axial direction can be adjusted according to the degree of tightening of the bolt operating portion 78. The height position of the reservoir tank 20 relative to the toilet main unit 2 can thus be adjusted.

Therefore after the reservoir tank 20 has been assembled at a predetermined installation position on the rear side of the toilet main unit 2, and is affixed to the toilet main unit 2 by the affixing devices 66, if the need arises to fine-tune the height position of the reservoir tank 20 or fine-tune the horizontal orientation of the reservoir tank 20, for example, the degree of tightening of the bolt operating portion 78 can be adjusted without removing the reservoir tank 20 from its predetermined installation position on the rear side of the toilet main unit 2. The height position of the reservoir tank 20 can thus be easily fine tuned and the orientation of the reservoir tank 20 can be fine tuned to a horizontal state simply by adjusting the degree of deformation of the flexible member 70, or by adjusting the degree of tightening between the toilet main unit 2 and the reservoir tank 20 by the affixing devices 66.

Note that in the present embodiment, a form is explained in which the affixing devices 66 comprises a flexible member 70. However a form is also acceptable in which the flexible member 70 is omitted.

As shown in FIG. 11, in the present embodiment the size of the long hole 20*d* for affixing the tank at the base portion 20*c* of the reservoir tank 20 is set to be somewhat larger than the outside diameter of the bolt 72 or the flexible member 70, thereby functioning as an adjustment hole. Therefore even with some degree of dimensional error in the reservoir tank 20 or the ceramic toilet main unit, the reservoir tank 20 can be moved within the range of the long hole 20*d* to fine-tune its position so that dimensional errors can be absorbed.

Figure 12:
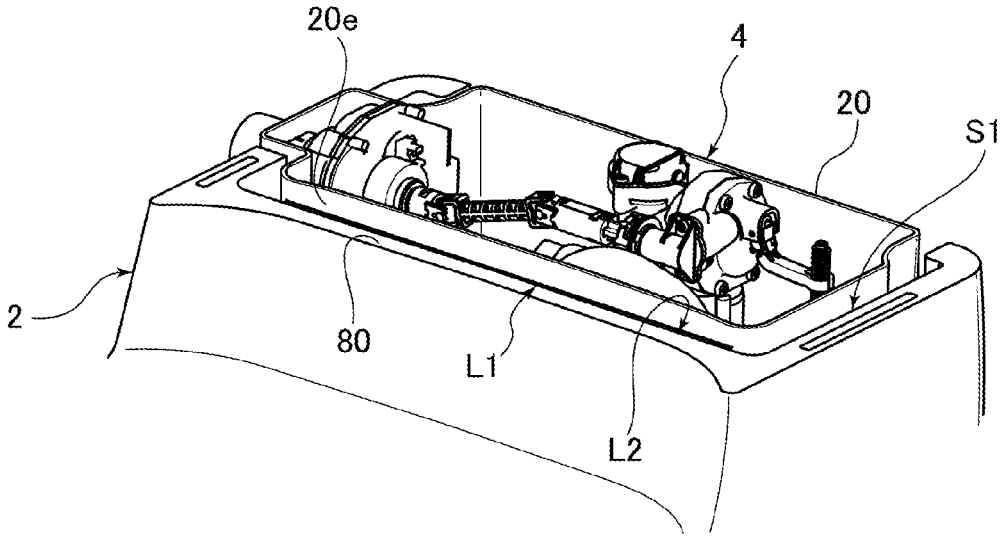
FIG. 12 is a perspective view showing the state of confirming the connection between the toilet main unit and the reservoir tank in a flush toilet according to a first embodiment of the invention.

Next, FIG. 12 is a perspective view showing the state of confirming the connection between the toilet main unit and the reservoir tank in a flush toilet according to a first embodiment of the invention.

As shown in FIGS. 2 and 12, a push-in depth confirmation line L1 extending in the horizontal direction is disposed on the outside front surface 20*e* of the reservoir tank 20 as a connection state confirmation means.

On the other hand, the line L2 extending in the horizontal left-right direction of the front side top edge portion 80 of the installation space S1 for the reservoir tank 20 on the rear side of the toilet main unit 2 is also a toilet main unit-side confirmation line L2 for confirming whether there is a match with the reservoir tank 20 push-in depth confirmation line L1, and functions as a connection state confirmation means.

Here, in the reservoir tank 20 shown in FIG. 12, after the reservoir tank 20 is assembled into the predetermined installation space S1 on the rear side of the toilet main unit 2 and before a tank cover 82 is assembled to the top end of the reservoir tank 20 rear side installation space S1 on the toilet main unit 2, the push-in depth confirmation line L1 is parallel to the toilet main unit-side confirmation line L2. In addition, the height positions of both L1 and L2 match one another, and the reservoir tank 20 is correctly installed at the predetermined installation position on the rear side of the toilet main unit 2.

Next, referring to FIGS. 1-15, a method for installing a flush water tank apparatus 4 in a flush toilet 1 according to the first embodiment of the invention at a predetermined installation position on the toilet main unit 2, as well as the action of a flush toilet 1 according to the first embodiment of the invention are explained.

Figure 13A:
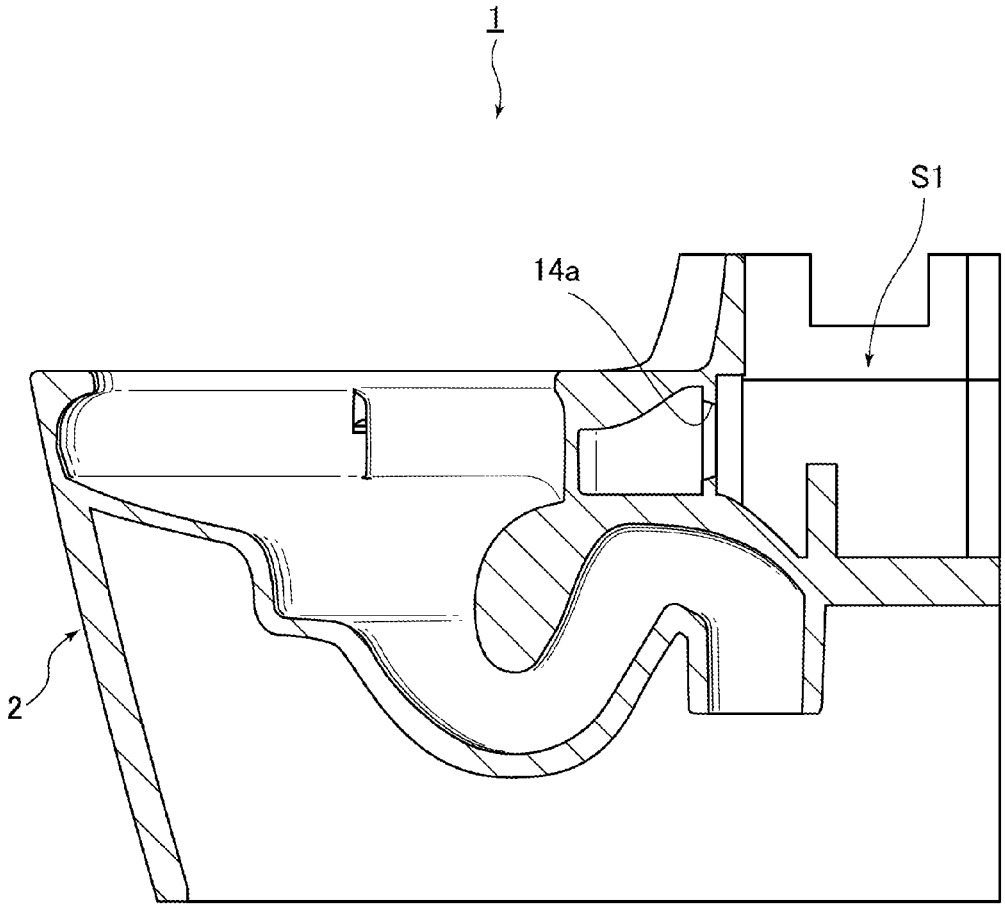
FIG. 13A is a schematic cross section showing a pre-installation start state, wherein the flush water tank apparatus reservoir tank in a flush toilet according to a first embodiment of the invention is not assembled to a predetermined installation position on the rear side of the toilet main unit.

First, FIG. 13A is a schematic cross section showing the state prior to start of installation, in which the flush water tank apparatus reservoir tank in a flush toilet according to a first embodiment of the invention is not assembled to a predetermined installation position on the rear side of the toilet main unit.

Figure 13B:
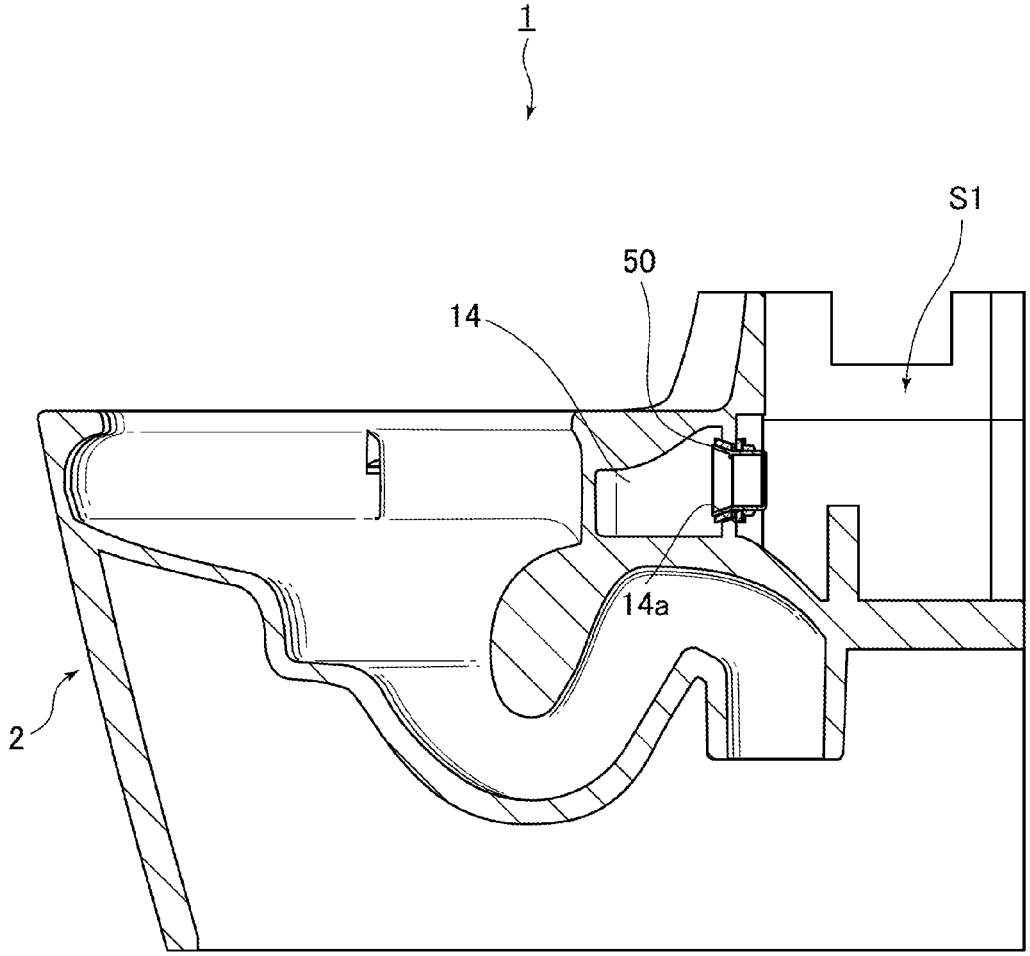
FIG. 13B is a schematic cross section showing a first installation state, wherein after the pre-installation start state shown in FIG. 13A, and before the flush water tank apparatus reservoir tank in a flush toilet according to a first embodiment of the invention is assembled to a predetermined installation position on the rear side of the toilet main unit, only a spud is connected in a watertight manner to the inlet of the conduit of the toilet main unit.

Next, FIG. 13B is a schematic cross section showing a first installation state, wherein after the pre-installation start state shown in FIG. 13A and before the flush water tank apparatus reservoir tank in a flush toilet according to a first embodiment of the invention is assembled to a predetermined installation position on the rear side of the toilet main unit, only a spud is connected in a watertight manner to the inlet of the conduit of the toilet body.

Figure 13C:
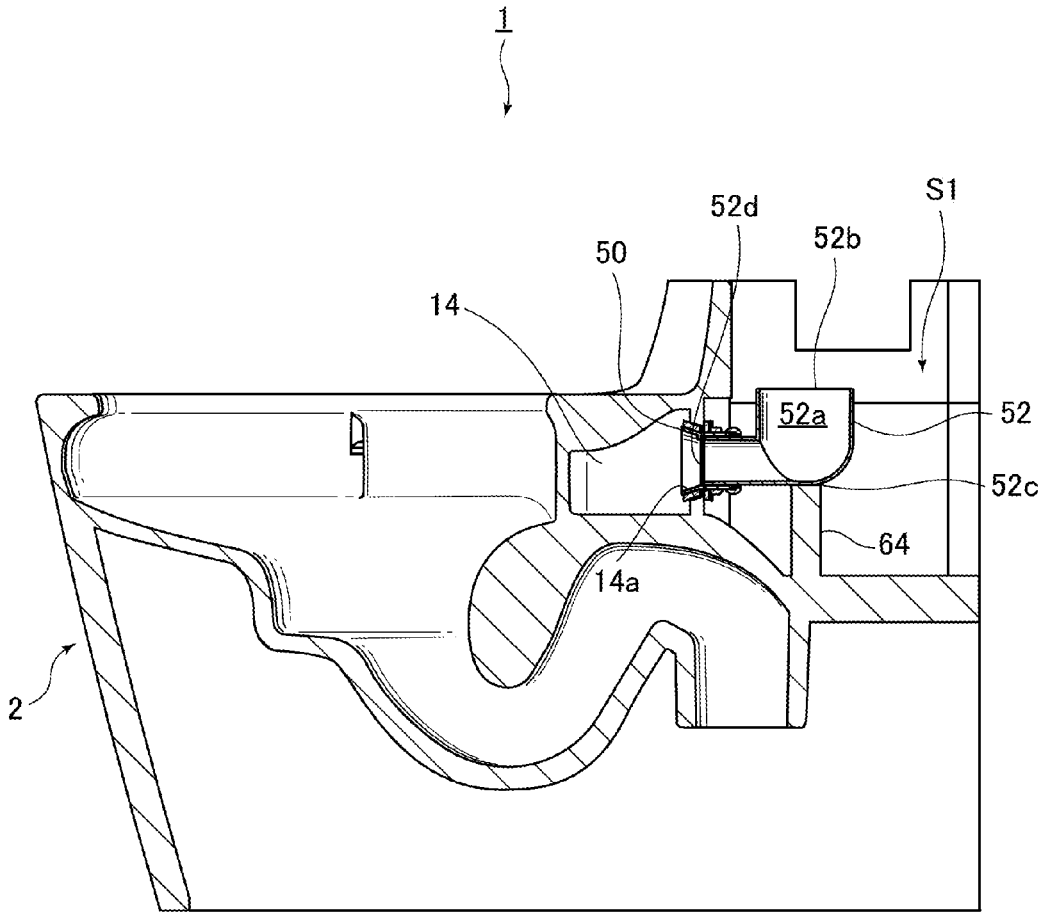
FIG. 13C is a schematic cross section showing a second installation state, wherein after the first installation state shown in FIG. 13B and before the flush water tank apparatus reservoir tank in a flush toilet according to a first embodiment of the invention is assembled to a predetermined installation position on the rear side of the toilet main unit, a connecting pipe member is connected in a watertight manner to a spud connected in a watertight manner to the inlet on the conduit of the toilet main unit.

Also, FIG. 13C is a schematic cross section showing a second installation state, wherein after the first installation start state shown in FIG. 13B and before the flush water tank apparatus reservoir tank in a flush toilet according to a first embodiment of the invention is assembled to a predetermined installation position on the rear side of the toilet main unit, a connecting portion is connected in a watertight manner to a spud connected in a watertight manner to the inlet on the conduit of the toilet main unit.

Figure 13D:
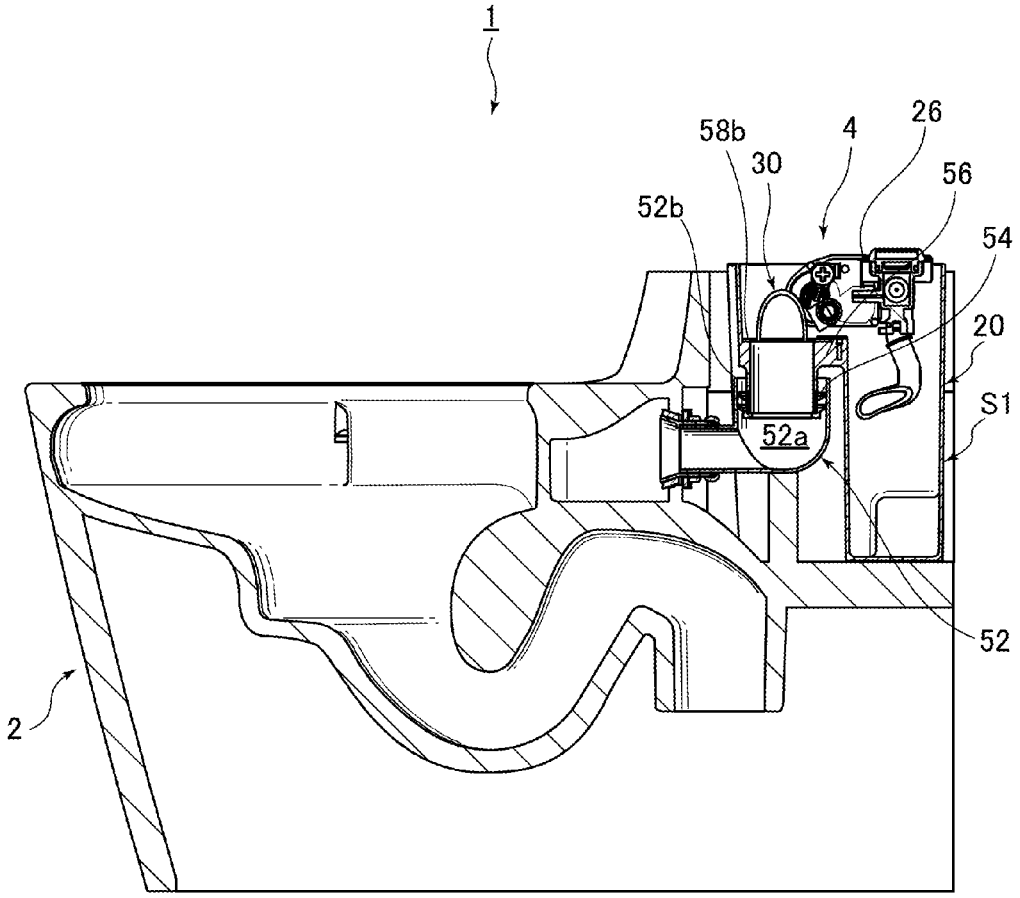
FIG. 13D is a schematic cross section showing a third installation state wherein after the second installation state shown in FIG. 13C, by the watertight connection to a connecting pipe member of a tank-side connecting portion on a flush toilet reservoir tank in a flush toilet according to a first embodiment of the invention, the reservoir tank is assembled from above to a predetermined installation position on the rear side of the toilet main unit.

In addition, FIG. 13D is a schematic cross section showing a third installation state wherein after the second installation state shown in FIG. 13C, by the watertight connection to a connecting pipe member of a tank-side connecting portion on a flush toilet reservoir tank in a flush toilet according to a first embodiment of the invention, the reservoir tank is assembled from above to a predetermined installation position on the rear side of the toilet main unit.

Figure 14A:
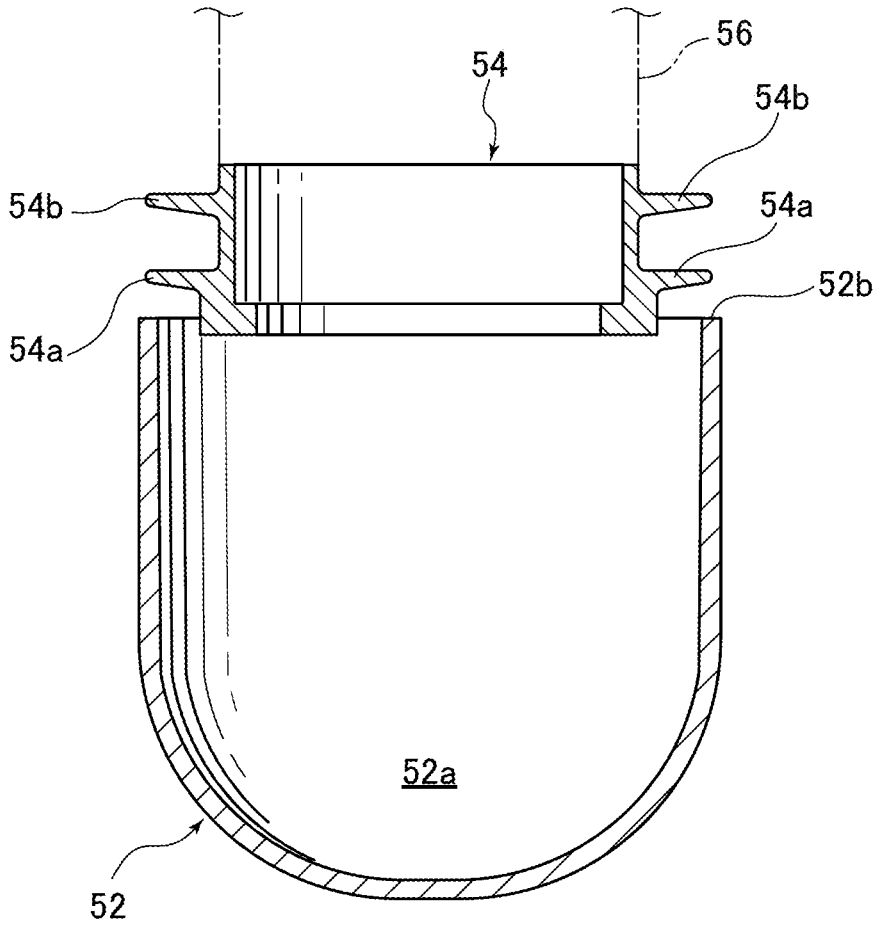
FIG. 14A is a schematic front elevation cross section showing the state between the second installation state shown in FIG. 13C and the third installation state shown in FIG. 13D, immediately before the lower fin portion and upper fin portion of a fin packing in a flush toilet according to a first embodiment of the invention is inserted into a connecting pipe member connecting pipe path.

Next, FIG. 14A is a schematic front elevation cross section showing the state between the second installation state shown in FIG. 13C and the third installation state shown in FIG. 13D, immediately before the lower fin portion and upper fin portion of a fin packing in a flush toilet according to a first embodiment of the invention is inserted into a connecting pipe member connecting pipe path.

Figure 14B:
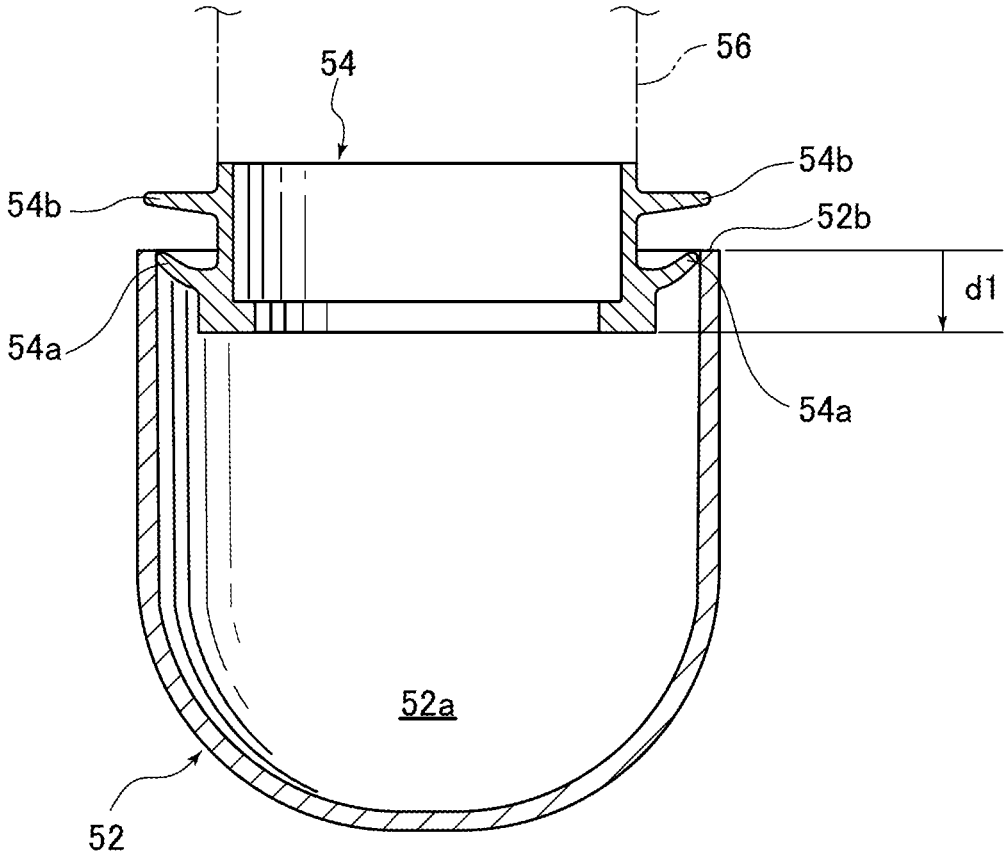
FIG. 14B is a schematic front elevation cross section showing the mid-insertion state when, from the state shown in FIG. 14A, only the lower fin portion of the fin packing in a flush toilet according to a first embodiment of the invention is inserted into the connecting pipe path of the connecting member.

Also, FIG. 14B is a schematic front elevation cross section showing the mid-insertion state when, from the state shown in FIG. 14A, only the lower fin portion of the fin packing in a flush toilet according to a first embodiment of the invention is inserted into the connecting pipe path of the connecting member.

Figure 14C:
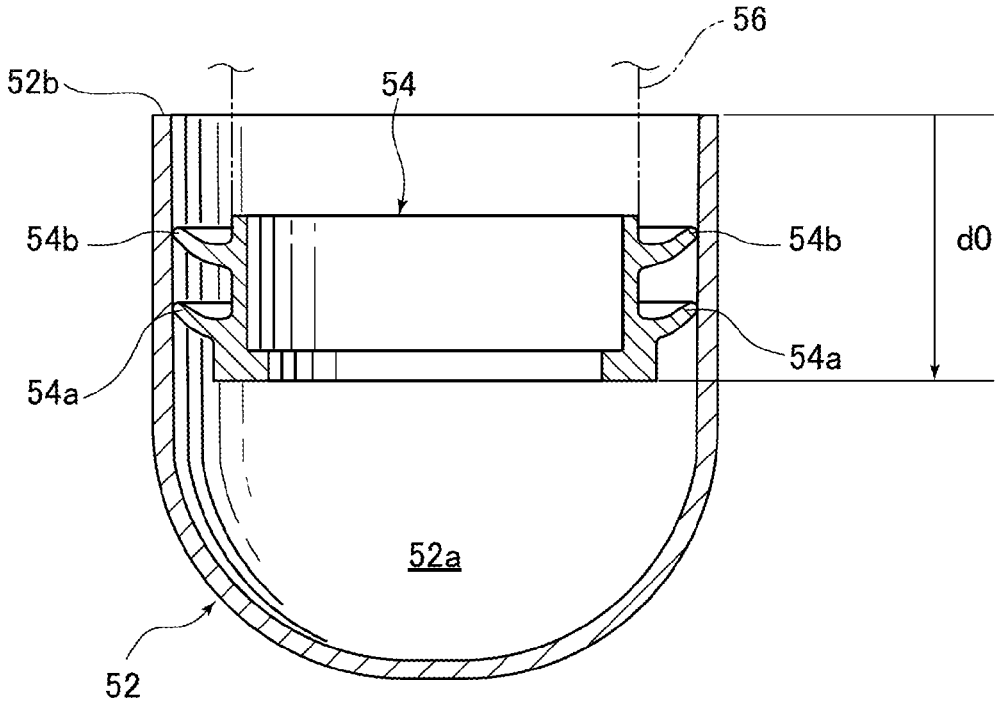
FIG. 14C is a schematic front elevation cross section showing the state in which, from the state shown in FIG. 14B, the lower and upper fins of the fin packing in a flush toilet according to a first embodiment of the invention are both inserted up to a fully inserted position in the connecting pipe path of the connecting pipe member.

In addition, FIG. 14C is a schematic front elevation cross section showing the state in which, from the state shown in FIG. 14B, the lower and upper fins of the fin packing in a flush toilet according to a first embodiment of the invention are both inserted up to a fully inserted position in the connecting pipe path of the connecting pipe member.

First, as shown in FIG. 13A, a worker starts an installation from a pre-installation start state in which a flush water tank apparatus 4 according to a first embodiment of the invention is installed inside a predetermined installation space S1 on the rear side of the toilet main unit 2. Thereafter, as shown in FIG. 13B, the spud 50 is inserted from above into the installation space S1. This spud 50 is then inserted from the rear direction relative to the inlet 14*a* of the conduit 14 of the toilet main unit 2. A first installation state is thus reached in which the spud 50 alone is connected in a watertight manner to the inlet 14*a* of the conduit 14 of the toilet body 2.

Next, after the first installation state shown in FIG. 13B, the connecting pipe member 52 is inserted from above into the installation space S1, as shown in FIG. 13C. Thereafter, with the top end 52*b* of the connecting pipe member 52 pointed upward, the connecting pipe member front end portion 52*d* is inserted from the rear side and connected in a watertight manner to the spud 50, which is connected in a watertight manner to the inlet 14*a* of the conduit 14 of the toilet main unit 2. This forms the second installation state, in which the connecting pipe member 52 is connected in a watertight manner to the spud 50. The connecting pipe member 52 connecting pipe portion (toilet main unit-side connecting pipe path 52*a*) and the conduit 14 of the toilet body 2 are placed in a state of communication.

Also, as shown in FIG. 13C, in the second installation state the connecting pipe member 52 bent portion bottom surface 52*c* is supported from the bottom side by the force dispersion portion 64 of the toilet main unit 2.

Next, as shown in FIG. 13D, after the second installation state shown in FIG. 13C relative to a reservoir tank 20 in which relevant parts such as a supply valve apparatus 26 and a jet pump unit 30 are pre-assembled, a fin packing 54 is attached to the bottom end portion of the tank-side connecting portion 56. In this state, the reservoir tank 20 is inserted from above into a predetermined installation space S1. Thereafter the tank-side connecting portion 56 bottom end portion and the fin packing 54 are inserted from the top end 52*b* of the connecting pipe member 52 into the connecting pipe path (the toilet main unit-side connecting pipe path 52*a*) of the connecting pipe member 52.

At this point a worker performs a pushing-in operation by hand to push the operating area surface F1 (see FIG. 5) on the top end 58*b* of the stepped portion 58 in the reservoir tank 20 downward from above. In this way the tank-side connecting portion 56 bottom end portion and the fin packing 54 are pushed from the top end 52*b* of the connecting pipe member 52 into the connecting pipe path 52*a* on the connecting pipe member 52 by a predetermined insertion distance d0 (see FIGS. 8 and 14C).

Thus as shown in FIG. 13D, the reservoir tank 20 is assembled from above into a predetermined installation position on the rear side of the toilet main unit 2. This then forms a third installation state wherein the tank-side connecting portion 56 bottom end portion and the fin packing 54 are connected in a watertight manner to the connecting pipe member 52.

Figure 15:
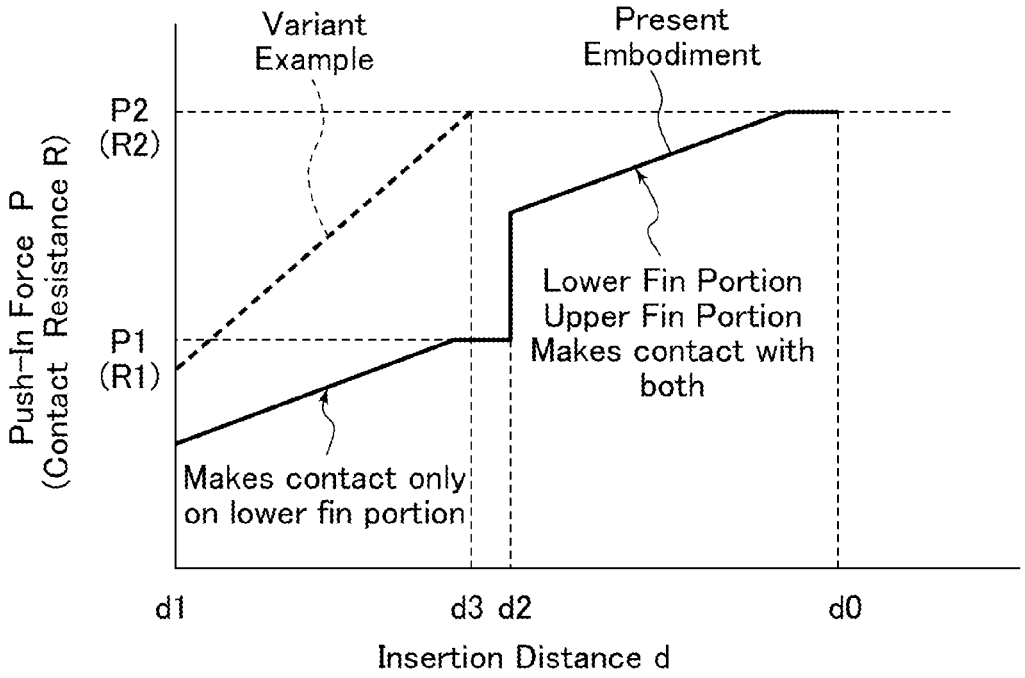
FIG. 15 is a diagram comparing a graph qualitatively depicting the relationship between post-contact insertion distance and contact resistance in the fin packing of a flush toilet according to a first embodiment of the invention, and a graph qualitatively depicting the relationship between insertion distance and contact resistance in a variant example of the fin packing of a flush toilet according to a first embodiment of the invention.

Note that FIG. 15 is a diagram comparing a graph qualitatively depicting the relationship between post-contact insertion distance and press-in force (contact resistance) in the fin packing of a flush toilet according to a first embodiment of the invention, and a graph qualitatively depicting the relationship between insertion distance and press-in force (contact resistance) in a variant example of the fin packing of a flush toilet according to a first embodiment of the invention.

Here the horizontal axis in FIG. 15 shows the insertion distance d by which the tank-side connecting portion 56 bottom end portion and fin packing 54 is inserted into the top end 52*b* of the connecting pipe member 52. The FIG. 15 vertical axis corresponds to the push-in force P when an operation is performed to push the operating area surface F1 (see FIG. 5) on the top end 58*b* of the stepped portion 58 of the reservoir tank 20 downward from above at the time the tank-side connecting portion 56 bottom end portion and fin packing 54 are inserted into the top end 52*b* of the connecting pipe member 52. This push-in force P matches the contact force R when each of the fin portions 54*a*, 54*b* on the fin packing 54 contacts the connecting pipe member 52 connecting pipe path (toilet main unit-side connecting pipe path 52*a*).

The tank-side connecting portion 56 bottom end portion and fin packing 54 shown in FIG. 14A are in the state immediately prior to being inserted into the connecting pipe member 52 connecting pipe path (the toilet main unit-side connecting pipe path 52*a*). From this state, as shown in FIGS. 14B and 15, the tank-side connecting portion 56 bottom end portion and the fin packing 54 are further inserted to an insertion distance d1. In this state, only the lower fin portion 54*a* of the fin packing 54 contacts the inside of the toilet main unit-side connecting pipe path 52*a*.

As shown in FIG. 15, the tank-side connecting portion 56 bottom end portion and the fin packing 54 are then further inserted to an insertion distance d2 (>d1). Contact then starts between both the lower fin portion 54*a* and the upper fin portion 54*b* of the fin packing 54 with the interior of the toilet main unit-side connecting pipe path 52*a*. At this point only the lower fin portion 54*a* of the fin packing 54 is in a contacting state in the section between insertion distances d1 and d2 in FIG. 15. Therefore the push-in force P and contact resistance R increase at a relatively mild slope and in essentially a proportional manner to the push-in force P1 and contact resistance R1.

Thereafter, as shown in FIGS. 14 and 15, the tank-side connecting portion 56 bottom end portion and the fin packing 54 are inserted to a maximum insertion distance d0 (>d2). The tank-side connecting portion 56 bottom end portion and the fin packing 54 are inserted up to an insertion-completed position inside the toilet main unit-side connecting pipe path 52*a* of the connecting pipe member 52, and an insertion-completed state is reached. At this point both the lower fin portion 54*a* and the upper fin portion 54*b* of the fin packing 54 are in a contacting state in the section from insertion distance d2 to d0 in FIG. 15. The push-in force P and contact force R increase up to a push-in force P2 and contact force R2 with greater resistance than the state in which only the lower fin portion 54*a* of the fin packing 54 is contacting, and essentially in proportion to one another.

Next, after the third installation state shown in FIG. 13D, the degree of tightening of the bolt 72 bolt operating portion 78 is adjusted by the affixing devices 66, as shown in FIGS. 9-11. As this adjustment is performed, the reservoir tank 20 rear surface side and the base portion 20*c* of the left and right sides are affixed to the toilet main unit 2 so that the horizontal state of the reservoir tank 20 orientation is maintained.

Then, as shown in FIG. 12, confirmation is made that the push-in depth confirmation line L1 is parallel to the toilet main unit-side confirmation line L2, and that the height positions of both lines L1 and L2 essentially match. If it confirmed that the reservoir tank 20 is correctly positioned at a predetermined installation position on the rear side of the toilet main unit 2, the tank cover 82 is attached to the top end of the installation space S1 of the reservoir tank 20 on the rear side of the toilet main unit 2. This results in the state shown in FIG. 3, in which installation is completed.

On the other hand if it cannot be confirmed that the reservoir tank 20 is correctly installed at the predetermined installation position on the rear side of the toilet main unit 2, there is a risk that the orientation of the reservoir tank 20 is not in a horizontal state. Therefore the position of the reservoir tank 20 can be shifted within the range of the tank-affixing long hole 20*d* on the base portion 20*c* of the reservoir tank 20 without removing the reservoir tank 20 from the installation position. By this means the position of reservoir tank 20 relative to the toilet main unit 2 in the front-back direction and left-right direction within the installation space S1 is adjusted and, as shown in FIGS. 9-11, the degree of tightening of the affixing device 66 bolt operating portion 78 is again adjusted. As these adjustments are made, the amounts of elastic deformation of the rubber bushing 68 and the flexible member 70, etc. are adjusted. Thus as shown in FIG. 12, fine tuning such as adjusting the height position of the reservoir tank 20 relative to the toilet main unit 2 is performed until the correct installation position can be confirmed.

In FIG. 15, on the other hand, as a variant example of a flush toilet 1 fin packing 54 according to a first embodiment of the invention, a single flexible fin portion is disposed in place of the two lower fin portions 54*a*, 54*b*. Because this single fin portion has greater thickness than each of the above-described fin portions 54*a* and 54*b*, it is provided with a higher rigidity than the fin portions 54*a* and 54*b*.

Therefore in the fin packing of the variant example, when contact begins between the single fin portion and the inside of the toilet main unit-side connecting pipe path 52*a* of the connecting pipe member 52, the push-in force P and contact force R increase proportionally to a larger resistance than the fin packing 54 comprising the two fin portions 54*a* and 54*b*. The push-in force P and contact force R can then reach push-in force P2 and contact force R2 at an insertion distance d3 which is smaller than insertion distance d2, and an insertion-completed state can be achieved.

In a flush toilet 1 according to the above-described first embodiment of the invention, when the reservoir tank 20 is connected in a watertight manner to the toilet main unit 2, the connecting pipe member 52 and the tank-side connecting portion 56 are covered so that a worker cannot directly access the surrounding area thereof. Therefore when a reservoir tank 20 is assembled from above to a predetermined installation position to the rear of the bowl 6 of the toilet main unit 2, the reservoir tank 20 is pushed into the connecting pipe member 52 by a worker. The tank-side connecting portion 56 is thus connected in a watertight manner to the connecting pipe member 52. The push-in force P acting on the fin packing 54 at this time is set to be smaller than the pull-out force acting on the fin packing 54 when the tank-side connecting portion 56 connected in a watertight manner to the connecting pipe member 52 is pulled out and removed from the connecting pipe member 52. Hence when the tank-side connecting portion 56 is connected in a watertight manner to the connecting pipe member 52 by insertion of the reservoir tank 20 into the connecting pipe member 52, the tank-side connecting portion 56 and the connecting pipe member 52 can be easily connected in a watertight manner using a relatively small push-in force P.

On the other hand a relatively large pull-out force is required when the tank-side connecting portion 56 is pulled out and removed from the toilet main unit-side connecting portion 52. The reservoir tank 20 can thus be prevented from unintentionally separating from the toilet main unit 2.

In a flush toilet 1 according to the present embodiment, if a packing member is hypothetically employed in which no flexible projecting portion (fin portion) is formed on the outer circumferential surface, the reservoir tank 20 is assembled to a predetermined installation space S1 further to the rear than the bowl 6 of the toilet body 2. Therefore when the reservoir tank 20 is pressed into the connecting pipe member 52, there is a risk that if the reservoir tank 20 is pressed into the wrong installation position, the starting push-in resistance will be relatively large, and the connecting pipe member 52 or the tank-side connecting portion 56 will break.

In contrast, with the flush toilet 1 according to the first embodiment of the invention, fin portions 54*a*, 54*b*, projecting radially outward, are formed over the entire perimeter of the outer circumferential surface of the fin packing 54 formed in approximately a ring shape. By so doing, when the reservoir tank 20 is pressed into the connecting pipe member 52, the degree of contact between the fin packing 54 flexible fin portions 54*a*, 54*b* and the toilet main unit-side connecting pipe path 52*a* of the connecting pipe member 52 changes in response to the amount of that pushing in. As the amount of that pushing in (push-in distance d) increases, the push-in resistance (contact force R) gradually increases.

Therefore when the reservoir tank 20 is pushed into the connecting pipe member 52, the initial push-in resistance (contact force R) is relatively small even if the reservoir tank 20 is pushed into the wrong installation position. For this reason, breakage of the connecting portion pipe member 52 or the tank-side connecting portion 56 can be avoided. In addition, the fact that the reservoir tank 20 is being pushed in at the wrong installation position becomes evident before breakage occurs.

In addition, in a flush toilet 1 according to the present embodiment multiple flexible fin portions 54*a*, 54*b* formed on the outer circumferential surface of the fin packing 54 can be arrayed at a given spacing in the axial direction on the outer circumferential surface of the fin packing 54. Therefore the initial push-in force P and the push-in resistance (contact force R) can be reduced when the reservoir tank 20 is pushed into the connecting pipe member 52. Thus the tank-side connecting portion 56 and the connecting pipe member 52 can be easily connected in a watertight manner with a relatively small push-in force P.

In addition, in the flush toilet 1 of the present embodiment a tank-side connecting pipe path 56*a* is formed, by which the interconnected connecting pipe member 52 and the tank-side connecting portion 56 communicate in the vertical direction. There is furthermore a force dispersion portion 64 which, with the reservoir tank 20 assembled from above into a predetermined installation position, is able to support the connecting pipe member 52 on the toilet main unit side, and is able to disperse the push-in force P acting on the connecting pipe member 52 from the tank-side connecting portion 56. These make it possible to disperse this push-in force P using the force dispersion portion 64 even if the tank-side connecting portion 56 is pushed downward from above relative to the connecting pipe member 52, causing an excessive push-in force P to be applied from the tank-side connecting portion 56 to the connecting pipe member 52. Breakage of the connecting pipe member 52 can thus be prevented.

In a flush toilet 1 according to the first embodiment, there are furthermore affixing devices 66 to enable affixing of the reservoir tank 20 to the toilet main unit 2 to maintain the horizontal orientation of the reservoir tank 20. The reservoir tank 20 can thus be stably affixed relative to the toilet main unit 2. Thus shifting of the reservoir tank 20 can be prevented, as can destabilization of the jet pump action due to movement of the reservoir tank 20 with each flush operation, causing fluctuation in the water level inside the reservoir tank 20.

Also, in the flush toilet 1 according to the present embodiment, the reservoir tank 20 is assembled by a worker from above into a predetermined installation space S1 further to the rear than the bowl 6 of the toilet body 2, and the reservoir tank 20 is connected in a watertight manner to the toilet main unit 2. When so doing, the top end 58*b* of the stepped portion 58 inside the reservoir tank 20 is positioned above the full water level WL0 in the reservoir tank 20 even if the areas around connecting pipe member 52 serving as toilet main unit-side connecting portion and the tank-side connecting portion 56 are covered so that a worker is unable to directly access them. A worker can by this means easily gain direct access to the top end 58*b* of the stepped portion 58 inside the reservoir tank 20 from above the reservoir tank 20.

Therefore a worker who has directly accessed the top end 58*b* of the stepped portion 58 inside the reservoir tank 20 can, simply by performing a watertight connecting operation for connecting the top end 52*b* of the connecting pipe member 52 to the tank-side connecting portion 56 through a fin packing 54 for the top end 58*b* of the stepped portion 58 in the reservoir tank 20, securely connect the tank-side connecting portion 56 to the connecting pipe member 52 in a watertight manner through the fin packing 54. Hence the reservoir tank 20 can be easily connected to the toilet main unit 2 in a watertight manner.

Also, using a flush toilet 1 according to the present embodiment, the stepped portion 58 in the reservoir tank 20 is the only stepped portion formed in the reservoir tank 20 so as to be positioned above the lowest water level DWL inside the reservoir tank 20. Space occupied by the stepped portion 58 in the reservoir tank 20 can thus be constrained. Therefore the entire reservoir tank 20 can be reduced in size.

In addition, using the flush toilet 1 according to the present embodiment, the stepped portion 58 inside the reservoir tank 20 is formed at the center in the left-right direction of the reservoir tank 20. In part of the top end 58*b* of the stepped portion 58 in the reservoir tank 20, the supply valve apparatus 26 and throat pipe 40, etc. are disposed more to one side than the other in the left-right direction inside the reservoir tank 20 to enable the pushing in operation. Therefore when the reservoir tank 20 is assembled by a worker from above to a predetermined installation position on the rear side of the conduit 14 of the toilet main unit 2, and the tank-side connecting portion 56 is connected in a watertight manner to the connecting pipe member 52 through the fin packing 54, the worker can directly access the top end 58*b* of the stepped portion 58 inside the reservoir tank 20. A worker can then secure operating space to connect the top end 58*b* of the stepped portion 58 inside the reservoir tank 20.

A worker can thus in a watertight manner securely connect a part of the top end 58*b* of the stepped portion 58 inside the reservoir tank 20. Hence the tank-side connecting portion 56 can be securely connected in a watertight manner to the connecting pipe member 52 through the fin packing 54, and the reservoir tank 20 can be securely connected in a watertight manner to the toilet main unit 2.

In addition, in the flush toilet 1 of the present embodiment, the top end 58*b* of the stepped portion 58 inside the reservoir tank 20 comprises an operating area surface F1, formed in an area in one direction of the left-right width thereof, such that a watertight connecting operation can be performed without interfering with the throat pipe-side connecting portion 60. Moreover, the top end 58*b* of the stepped portion 58 is between the throat pipe-side connecting portion 60 and the reservoir tank 20 inside front surface 20*a* adjacent thereto, and comprises a front area surface F2 smaller in surface area than the operating area surface F1. By these means, the operating area surface F1 of the top end 58*b* of the stepped portion 58 inside the reservoir tank 20 can be made relatively large without interfering with the throat pipe-side connecting portion 60. Hence the watertight connection operation in the operating area surface F1 on the top end 58*b* of the stepped portion 58 can be facilitated.

The operating area surface F2 of the top end 58*b* of the stepped portion 58 in the reservoir tank 20 can also be made relatively small. Dead space inside the reservoir tank 20 can thus be minimized. Therefore the entire reservoir tank 20 can be reduced in size.

Using the flush toilet 1 according the present embodiment, the fin packing 54, tank-side connecting portion 56, and connecting pipe member 52 are each respectively disposed to mutually overlap below the stepped portion 58 with the reservoir tank 20 assembled from above to a predetermined installation position. As a result of the operating area surface F1 being pushed downward, the bottom end portion of the tank-side connecting portion 56 is inserted into the toilet main unit-side connecting pipe path 52*a* of the connecting pipe member 52 through the fin packing 54 so that a watertight connection can be made between the reservoir tank 20 and the toilet main unit 2. Therefore when an operation is performed by a worker to push in the operating area surface F1 on the stepped portion 58 inside the reservoir tank 20 during installation of the reservoir tank 20 from above into a predetermined installation space S1 behind the bowl 6 of the toilet body 2, a push-in force P can be efficiently applied to the fin packing 54, the tank-side connecting portion 56, and the connecting pipe member 52 which respectively overlap in the vertical downward direction of this stepped portion 58, securely connecting them to one another in a watertight manner.

Hence a relatively small push-in force P on the stepped portion 58 suffices for the push-in operation when the fin packing 54, tank-side connecting portion 56, and connecting pipe member 52 are respectively connected in a watertight manner.

Hence it is also possible to reduce the force applied directly by the push-in operation to the stepped portion 58. The entire reservoir tank 20 can thus also be reduced in size.

In addition, using the flush toilet 1 according to the present embodiment, the operating area surface F1 of the top end 58*b* of the stepped portion 58 is pushed downward with the reservoir tank 20 assembled to a predetermined installation position from above. At this point, the push-in force P acting on the connecting pipe member 52 from the tank-side connecting portion 56 can be dispersed by the force dispersion portion 64, disposed so as to be capable of supporting the bottom surface 52*c* of the bent portion of the connecting pipe member 52. This push-in force P can therefore be dispersed using the force dispersion portion 64 even if the tank-side connecting portion 56 is pushed downward from above relative to the connecting pipe member 52, causing an excessive push-in force P to be applied from the tank-side connecting portion 56 to the connecting pipe member 52. Breakage of the connecting pipe member 52 can thus be prevented.

Figure 16:
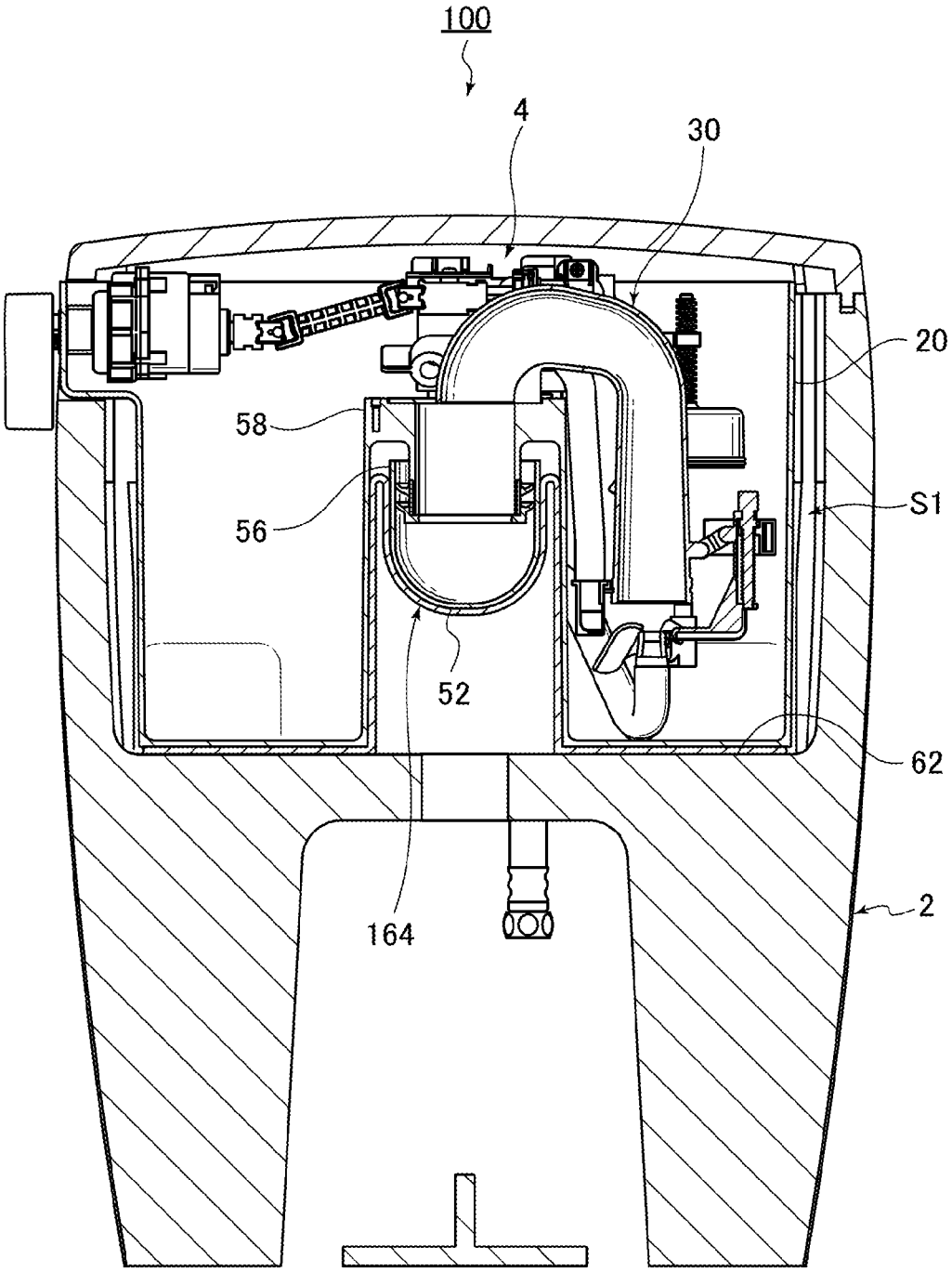
FIG. 16 is a front elevation cross section similar to FIG. 4, showing a flush toilet according to a second embodiment of the invention.

Next, referring to FIG. 16, a flush toilet 100 according to a second embodiment of the invention is explained.

FIG. 16 is a front elevation cross section similar to FIG. 4, showing a flush toilet according to a second embodiment of the invention.

Here, in the flush toilet 1 according to the second embodiment of the invention shown in FIG. 16, the same reference numerals are applied to parts identical to those in the flush toilet 1 according to the first embodiment of the invention shown in FIG. 4, and an explanation thereof is here omitted.

As shown in FIG. 16, a force dispersion portion 164 for supporting a connecting pipe member 52 from below is provided in the flush toilet 100. This differs from the force dispersion portion 64 formed as a single piece with the flush toilet 1 according to the above-described first embodiment of the invention, in that a base portion 164*a* on this force dispersion portion 164 is affixed to the bottom surface 62 of the installation space S1 of the reservoir tank 20 on the rear side of the toilet main unit 2.

In a flush toilet 100 according to the above-described second embodiment of the invention, this push-in force P can be dispersed using the force dispersion portion 164 even if the tank-side connecting portion 56 is pushed downward from above relative to the connecting pipe member 52, causing an excessive push-in force P to be applied from the tank-side connecting portion 56 to the connecting pipe member 52. Breakage of the connecting pipe member 52 can thus be prevented.

Figure 17:
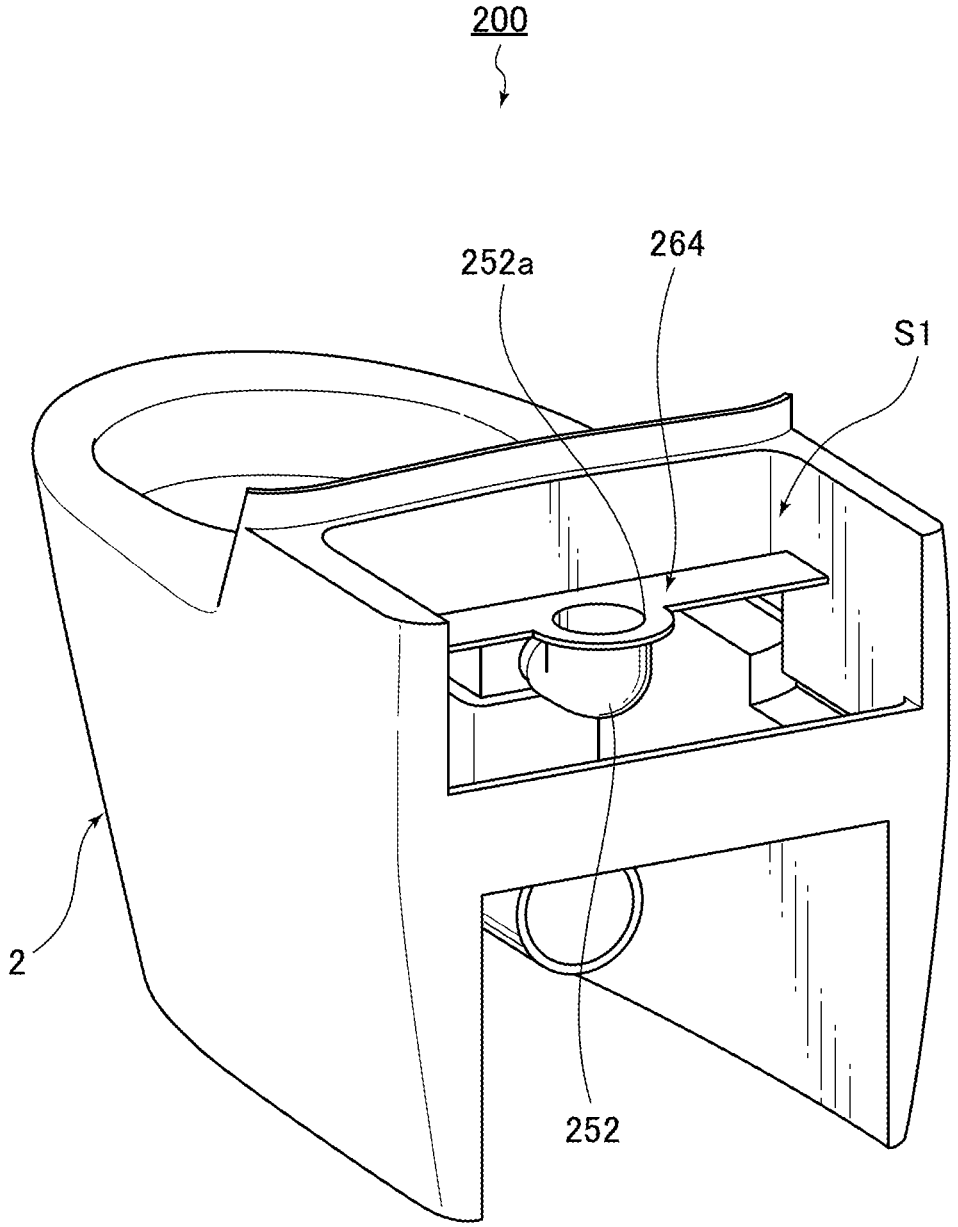
FIG. 17 is a schematic perspective view wherein in a flush toilet according to a third embodiment of the invention, a toilet main unit is seen from the rear side in a state prior to assembly of a flush water tank apparatus reservoir tank to a predetermined installation position.

Next, referring to FIG. 17, a flush toilet 200 according to a third embodiment of the invention is explained.

FIG. 17 is a schematic perspective view wherein in a flush toilet according to a third embodiment of the invention, a toilet main unit is seen from the rear side in a state prior to assembly of a flush water tank apparatus reservoir tank to a predetermined installation position.

Here, in the flush toilet 1 according to the third embodiment of the invention shown in FIG. 17, the same reference numerals are applied to parts identical to those in the flush toilet 1 according to the above-described first embodiment of the invention, and an explanation thereof is here omitted.

As shown in FIG. 17, in a flush toilet 200 according to the present embodiment, a connecting pipe member 262, connected in a watertight manner between a spud 50 connected in a watertight manner to the inlet 14*a* of the conduit 14 on the toilet main unit 2 and the tank-side connecting portion 56 of the reservoir tank 20, comprises a force dispersion portion 264 formed in a flange shape as a single piece in the left-right direction from the top end 252*a* thereof. This differs from the force dispersion portion 64 formed as a single piece with the toilet main unit 2 of the flush toilet 1 according to the above-described first embodiment of the invention, and from the force dispersion portion 164 of the flush toilet 100 according to the second embodiment of the invention, in that both end portions in the left-right direction of the force dispersion portion 264 are supported and affixed by a portion of the toilet main unit 2.

In a flush toilet 200 according to the above-described third embodiment of the invention, this push-in force P can be dispersed using the force dispersion portion 264 even if the tank-side connecting portion 56 is pushed downward from above relative to the connecting pipe member 252, causing an excessive push-in force P to be applied from the tank-side connecting portion 56 to the connecting pipe member 252. Breakage of the connecting pipe member 252 can thus be prevented.

Figure 18:
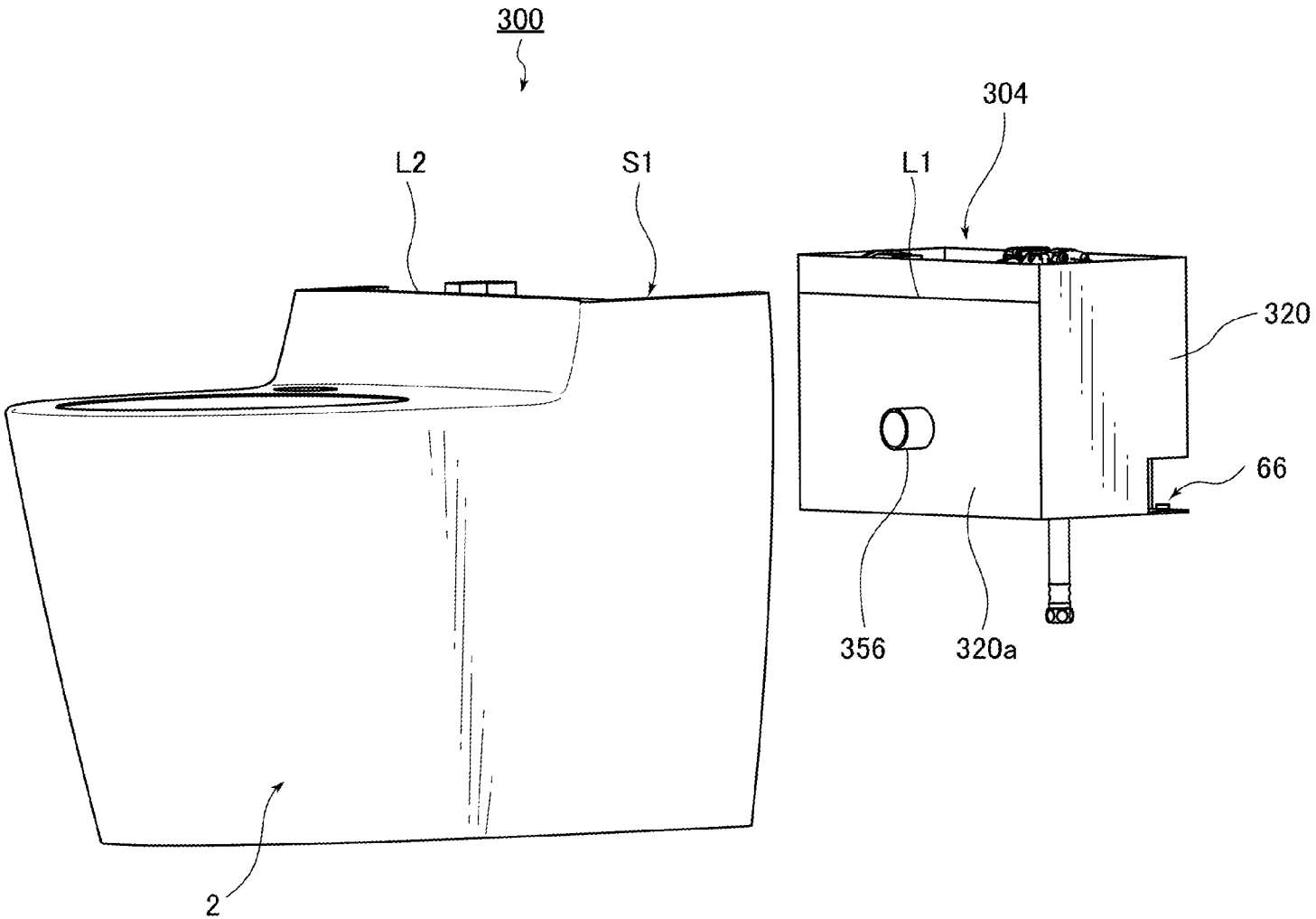
FIG. 18 is a partial perspective view of a flush toilet according to a fourth embodiment of the invention.
Figure 19A:
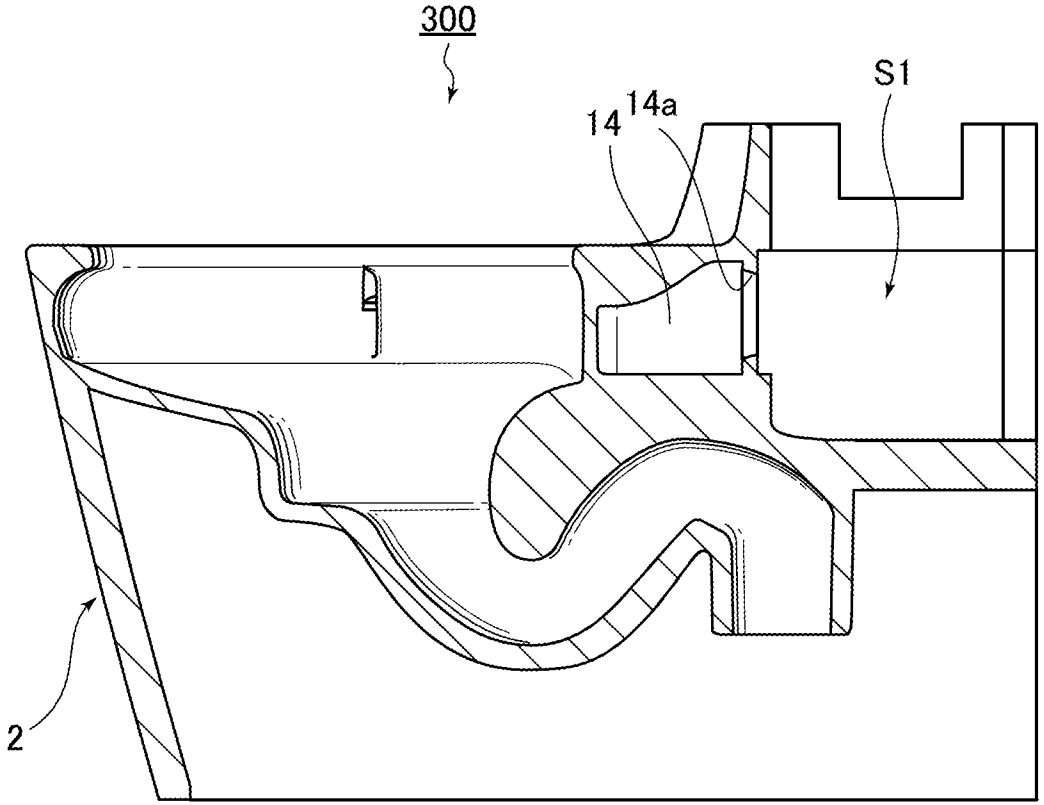
FIG. 19A is a schematic cross section showing the state prior to start of installation, in which the flush water tank apparatus reservoir tank in a flush toilet according to a fourth embodiment of the invention is not assembled to a predetermined installation position on the rear side of the toilet main unit.
Figure 19C:
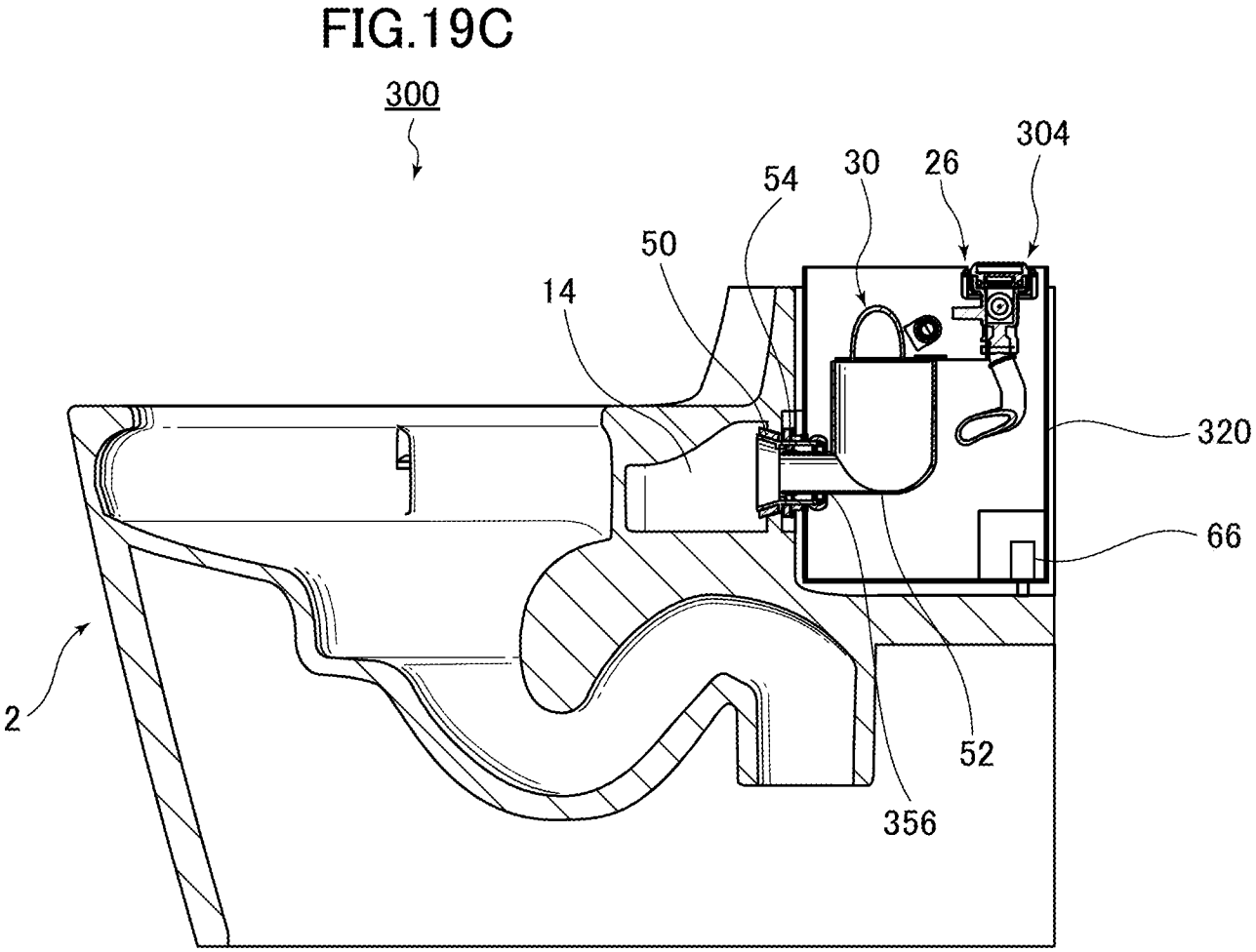
FIG. 19C is a schematic cross section showing a second installation state in which, after the first installation state shown in FIG. 19B, by connecting the tank-side connecting portion of the flush water tank apparatus in a flush toilet according to a fourth embodiment of the invention in a watertight manner to a spud connected in a watertight manner to the inlet on the conduit of the toilet main unit through a fin packing, the reservoir tank is assembled from behind to a predetermined installation position on the rear side of the toilet main unit.

Next, referring to FIGS. 18 through 19C, a flush toilet 300 according to a fourth embodiment of the invention is explained.

FIG. 18 is a partial perspective view of a flush toilet according to a fourth embodiment of the invention.

Next, FIG. 19A is a schematic cross section showing the state prior to start of installation, in which the flush water tank apparatus reservoir tank in a flush toilet according to a fourth embodiment of the invention is not assembled to a predetermined installation position on the rear side of the toilet main unit.

Also, FIG. 19B is a schematic cross section showing a first installation state, wherein after the pre-installation start state shown in FIG. 19A and before the flush water tank apparatus reservoir tank in a flush toilet according to a fourth embodiment of the invention is assembled from behind to a predetermined installation position on the rear side of the toilet main unit, only a spud is connected in a watertight manner to the inlet of the conduit of the toilet main unit.

Furthermore, FIG. 19C is a schematic cross section showing a second installation state in which, after the first installation state shown in FIG. 19B, by connecting the tank-side connecting portion of the flush water tank apparatus in a flush toilet according to a fourth embodiment of the invention in a watertight manner to a spud connected in a watertight manner to the inlet on the conduit of the toilet main unit through a fin packing, the reservoir tank is assembled from behind to a predetermined installation position on the rear side of the toilet main unit.

Here, in the flush toilet 300 according to the fourth embodiment of the invention shown in FIGS. 18-19C, the same reference numerals are applied to parts identical to those in the flush toilet 1 according to the above-described first embodiment of the invention, and an explanation thereof is here omitted.

First, as shown in FIGS. 18-19C, in a flush toilet 300 according to a fourth embodiment of the invention, no toilet room wall (not shown) or the like is disposed adjacent to the rear-most edge of the toilet main unit 2. The flush water tank apparatus 304 is in an area in which the rear side of the predetermined installation space S1 on the rear side of the toilet main unit 2 is open. Furthermore, in the flush toilet 300 of the present embodiment a reservoir tank 320 can be assembled from the rear side relative to an installation space S1. On this point, the flush toilet 300 of the present embodiment differs in that the reservoir tank 20 in the flush toilet according to the above-described first embodiment of the invention must be inserted from above into a predetermined installation space S1 to the rear of the toilet main unit 2 for assembly.

Also, as shown in FIGS. 18 and 19B, when assembled by insertion into the reservoir tank 320, the front end portion of the connecting pipe member 52 extends so as to penetrate the inside front surface 320*a* of the reservoir tank 320, forming a tank-side connecting portion 356. On this point, the flush toilet 300 of the present embodiment differs from the tank-side connecting portion 56 on the reservoir tank 20 in the flush water tank apparatus 4 in a flush toilet 1 according to the above-described first embodiment of the invention.

In addition, the front wall portion 320*a* of the reservoir tank 320 and the tank-side connecting portion 356 are connected in a watertight manner through a packing 354.

Next, referring to FIGS. 18-19C, a method for installing a flush water tank apparatus 304 in a flush toilet 300 according to a fourth embodiment of the invention at a predetermined installation position on the toilet main unit 2 is explained.

First, as shown in FIGS. 18 and 19A, a worker starts an installation from a pre-installation start state in which a flush water tank apparatus 4 according to the first embodiment of the invention is installed inside a predetermined installation space S1 on the rear side of the toilet main unit 2. Thereafter, as shown in FIG. 19B, the spud 50 is inserted from the rear side into the installation space S1, and this spud 50 is inserted from the rear side relative to the inlet 14*a* of the conduit 14 on the toilet main unit 2. A first installation state is thus reached in which the spud 50 alone is connected in a watertight manner to the inlet 14*a* of the conduit 14 of the toilet main unit 2.

Next, after the installation state shown in FIG. 19B, the reservoir tank 320, within which the supply valve apparatus 26, jet pump unit 30, connecting pipe member 52, and the like are pre-assembled as shown in FIGS. 18 and 19C, is inserted from the rear side into a predetermined installation space on the rear side of the toilet main unit 2.

As shown in FIGS. 19B and 19C, the entire reservoir tank 320 is moved still further forward relative to the toilet main unit 2. The tank-side connecting portion 356, being the front end portion of the connecting pipe member 52, is thus inserted and connected in a watertight manner from the rear side through the fin packing 54 to the spud 50, which is connected in a watertight manner to the inlet 14*a* of the conduit 14 on the toilet main unit 2, thus forming a second installation state.

Next, after the second installation state shown in FIG. 19C, the reservoir tank 20 is affixed to the toilet main unit 2 by affixing devices 66 so that the reservoir tank 20 orientation is maintained in a horizontal state.

Then, as shown in FIG. 18, confirmation is made that the push-in depth confirmation line L1 is parallel to the toilet main unit-side confirmation line L2, and that the height positions of both lines L1 and L2 essentially match one another. If confirmed that the reservoir tank 320 is correctly positioned at a predetermined installation position on the rear side of the toilet main unit 2, the tank cover 82 is attached to the top end of the reservoir tank 320 installation space S1 on the rear side of the toilet main unit 2, and the installation is completed.

On the other hand if it cannot be confirmed that the reservoir tank 320 is correctly installed at the predetermined installation position on the rear side of the toilet main unit 2, there is a risk that its orientation of the reservoir tank 320 is not in a horizontal state. The affixing devices 66 etc. are therefore again fine-tuned until the correct installation state can be confirmed.

In a flush toilet 300 according to the above-described fourth embodiment of the invention, when the reservoir tank 320 is connected in a watertight manner to the toilet main unit 2, the tank-side connecting portion 356 of the connecting pipe member 52 is covered so that a worker cannot directly access the surrounding area thereof. Therefore when the reservoir tank 320 is assembled from the rear side into the predetermined installation space S1 further to the rear than the bowl 6 of the toilet main unit 2, the reservoir tank 320 is pushed by a worker from the rear side into the predetermined installation space S1 in the toilet main unit 2. As a result, the tank-side connecting portion 356 is connected in a watertight manner to the spud 50 through the fin packing 54. When this happens, the push-in force P acting on the fin packing 54 is set to be less than the pull-out force acting on the fin packing 54 when the tank-side connecting portion 56 is pulled out and removed from the spud 50. Therefore when the tank-side connecting portion 356 is connected in a watertight manner to the spud 50 by insertion of the reservoir tank 320 into the toilet main unit 2, the tank-side connecting portion 356 and the spud 50 can be easily connected in a watertight manner using a relatively small push-in force P.

On the other hand, a relatively large pull-out force is required when the tank-side connecting portion 356 is pulled out and removed from the spud 50. Therefore the reservoir tank 320 can be prevented from unintentionally separating from the toilet main unit 2.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied by a jet pump action, the flush toilet comprising:

a toilet main unit including a bowl configured to receive waste and a conduit configured to guide flush water to the bowl;

a tank assembled from a top side of the toilet main unit or a rear side of the toilet main unit to a predetermined installation position in the toilet main unit further to a rear than the bowl of the toilet main unit, the tank being configured to store a portion of the flush water supplied from a water supply source and to supply the flush water to the conduit in the toilet main unit, the tank including a jet pump unit disposed on an interior of the tank, at least a portion of the jet pump unit being submerged, wherein the jet pump unit includes a jet nozzle configured to spray the flush water supplied from the water supply source, and a throat pipe including a suction port at one end of the throat pipe and an outlet at other end of the throat pipe, the outlet of the throat pipe being configured to cause the flush water to flow out toward the conduit in the toilet main unit, wherein the jet nozzle is configured to induce the jet pump action so as to increase a flow volume of flush water flowing in the throat pipe more than a flow volume of flush water sprayed from the jet nozzle by jet spraying flush water from the suction port on the throat pipe toward an interior of the throat pipe so that increased flow volume of flush water is supplied from the throat pipe toward the conduit on the toilet main unit;

a toilet main unit-side connecting portion forming a toilet main unit-side connecting pipe path in the toilet main unit-side connecting portion, one end of the toilet main unit-side connecting portion being disposed either as a single piece or as a separate piece with the conduit of the toilet main unit, and other end of the toilet main unit-side connecting portion being connected to the tank;

a tank-side connecting portion disposed on a front side of the tank, the tank-side connecting portion being connected to the toilet main unit-side connecting portion so as to form a tank-side connecting pipe path configured to communicate with the toilet main unit-side connecting pipe path; and a seal member disposed on either the toilet main unit-side connecting portion or the tank-side connecting portion, the seal member being configured to connect in a watertight manner between the toilet main unit-side connecting portion and the tank-side connecting portion with the tank assembled to the predetermined installation position from the top side or the rear side;

wherein when the tank is connected in a watertight manner to the toilet main unit, surroundings of the toilet main unit-side connecting portion and the tank-side connecting portion are covered such that a worker cannot directly access the surroundings of the toilet main unit-side connecting portion and the tank-side connecting portion; and wherein the seal member is configured that when the tank is assembled from the top side or the rear side to the predetermined installation position, a push-in force acting on the seal member when the tank-side connecting portion is connected in a watertight manner to the toilet main unit-side connecting portion by pushing the tank into the toilet main unit-side connecting portion is set to be smaller than a pull-out force acting on the seal member when the tank-side connecting portion connected in a watertight manner to the toilet main unit-side connecting portion is pulled out and removed from the toilet main unit-side connecting portion.

2. The flush toilet according to claim 1, wherein the seal member is a packing member formed in approximately a ring shape, and the packing member includes one or more flexible projecting portions on an outer circumferential surface of the packing member, the flexible projecting portion being formed so as to project radially and outwardly over an entire circumference on the outer circumferential surface of the packing member.

3. The flush toilet according to claim 2, wherein the one or more flexible projecting portions are multiple projecting portions configured to be spaced apart in an axial direction on the outer circumferential surface of the packing member.

4. The flush toilet according to claim 2, wherein the toilet main unit-side connecting portion and the tank-side connecting portion are configured to form a connecting pipe path communicating in a vertical direction when the toilet main unit-side connecting portion and the tank-side connecting portion are connected to each other; and the flush toilet further comprises a force dispersion portion disposed to be able to support the toilet main unit-side connecting portion with the tank assembled from above to the predetermined installation position, the force dispersion portion being configured to disperse the push-in force from the tank-side connecting portion onto the toilet main unit-side connecting portion.

5. The flush toilet according to claim 2, further comprises a horizontality maintaining portion configured to affix the tank to the toilet main unit so that an orientation of the tank is maintained in a horizontal state.

6. The flush toilet according to claim 1, wherein the tank is assembled from the top side into the predetermined installation position further to the rear side than the bowl of the toilet main unit;

the toilet main unit-side connecting pipe path is formed to point upward;

the tank-side connecting pipe path is formed to extend upward from one end; and the tank includes a stepped portion configured to project from a front surface of the tank rearward on the interior of the tank and to extend upward from a bottom surface of the tank;

wherein the stepped portion includes a top end, to which a throat pipe-side connecting portion forming the outlet of the throat pipe is connected, and on which a connecting port communicating with the tank-side connecting pipe path is formed; and the top end of the stepped portion is positioned above a full water level inside the tank so that when the tank is assembled from above to the predetermined installation position, a worker can perform a watertight connection operation to connect the toilet main unit-side connecting portion and the tank-side connecting portion in a watertight manner;

wherein the stepped portion is configured to connect the tank-side connecting portion through the seal member to the toilet main unit-side connecting portion in a watertight manner when the watertight connection operation is performed.

7. The flush toilet according to claim 6, wherein the stepped portion is a sole stepped portion formed inside the tank so as to be positioned above a minimum water level inside the tank.

8. The flush toilet according to claim 7, wherein the tank includes in its interior a supply valve configured to supply and cut off the flush water supplied from the water supply source to the jet nozzle; and wherein the stepped portion is formed at the center portion in a left-right direction of the interior of the tank, and the supply valve and the throat pipe are disposed more on one side in the left-right direction of the interior of the tank so as to enable the watertight connection operation for a portion of the top end of the stepped portion.

9. The flush toilet according to claim 7, wherein the top end of the stepped part includes an operating region surface and a front region surface, the operating region surface being formed in a left-right width direction region of the top end of the stepped part so as to enable the watertight connecting operation, and the front region surface being formed between the throat pipe-side connecting portion and the front wall portion of the tank closely adjacent to the throat pipe-side connecting portion, wherein an area of the front region surface is smaller than an area of the operating region surface.

10. The flush toilet according to claim 7, wherein the top end of the stepped portion includes an operating area surface capable of the watertight connection operation; and wherein with the tank assembled from the top side of the predetermined installation position, the seal member, the tank-side connecting portion, and the toilet main unit-side connecting portion are respectively disposed to mutually overlap in a vertical downward direction of the stepped portion; and the watertight connection operation is a push-in operation in which when the tank is assembled from above to the predetermined installation position, the operating area surface is pushed downward by a worker, and the stepped portion is configured to enable the watertight connection between the tank and the toilet main unit by the push-in operation so as to push the tank-side connecting portion through the seal member into the toilet main unit-side connecting portion.

11. The flush toilet according to claim 10, further comprises a force dispersion portion configured to enable support of the toilet main unit-side connecting portion so as to disperse the pushing-in force action on the toilet main unit-side connecting portion from the tank-side connecting portion when the tank is assembled to a predetermined installation position from above, and the operating area surface of the top end of the stepped portion is pushed downward.

* * * * *